US007586505B2

(12) United States Patent
Yamazaki et al.

(10) Patent No.: US 7,586,505 B2
(45) **Date of Patent: *Sep. 8, 2009**

(54) LIGHT EMITTING DEVICE AND ELECTRONIC APPARATUS USING THE SAME

(75) Inventors: Shunpei Yamazaki, Tokyo (JP); Jun Koyama, Kanagawa (JP)

(73) Assignee: Semiconductor Energy Laboratory Co., Ltd., Kanagawa-Ken (JP)

( * ) Notice: Subject to any disclaimer, the term of this patent is extended or adjusted under 35 U.S.C. 154(b) by 524 days.

This patent is subject to a terminal disclaimer.

(21) Appl. No.: 11/313,854

(22) Filed: Dec. 22, 2005

(65) Prior Publication Data

US 2006/0103684 A1 May 18, 2006

Related U.S. Application Data

(62) Division of application No. 10/259,283, filed on Sep. 27, 2002, now Pat. No. 7,158,157.

(30) Foreign Application Priority Data

Sep. 28, 2001 (JP) ..... 2001-300539

(51) Int. Cl.
*G09G 5/10* (2006.01)

(52) U.S. Cl. ..... 345/691; 345/690

(58) Field of Classification Search ..... 345/690, 345/691

See application file for complete search history.

(56) References Cited

U.S. PATENT DOCUMENTS 5,247,190 A 9/1993 Friend et al.

(Continued)

FOREIGN PATENT DOCUMENTS

EP 1 102 234 A2 11/2000

(Continued)

OTHER PUBLICATIONS

Australian Search Report and Written Opinion for Singapore Patent Application No. 200205774-3; filed (Sep. 27, 2002), Mailed Jul. 12, 2005.

(Continued)

*Primary Examiner*—Alexander Eisen
*Assistant Examiner*—Viet Pham
(74) *Attorney, Agent, or Firm*—Nixon Peabody LLP; Jeffrey L. Costellia

(57) ABSTRACT

Providing a light emitting device capable of suppressing the variations of luminance of OLEDs associated with the deterioration of an organic light emitting material, and achieving a consistent luminance. An input video signal is constantly or periodically sampled to sense a light emission period or displayed gradation level of each of light emitting elements of pixels and then, a pixel suffering the greatest deterioration and decreased luminance is predicted from the accumulations of the sensed values. A voltage supply to the target pixel is corrected for achieving a desired luminance. The other pixels than the target pixel are supplied with an excessive voltage and hence, the individual gradation levels of the pixels are lowered by correcting the video signal for driving the pixel with the deteriorated light emitting element on as-needed basis, the correction of the video signal made by comparing the accumulation of the sensed values of each of the other pixels with a previously stored data on a time-varying luminance characteristic of the light emitting element.

12 Claims, 20 Drawing Sheets

U.S. PATENT DOCUMENTS

| | | | | |
|---|---|---|---|---|
| 5,399,502 | A | 3/1995 | Friend et al. | |
| 5,594,463 | A | 1/1997 | Sakamoto | |
| 5,708,451 | A * | 1/1998 | Baldi | 345/75.2 |
| 5,778,146 | A | 7/1998 | Kawaski et al. | |
| 6,011,529 | A | 1/2000 | Ikeda | |
| 6,127,991 | A | 10/2000 | Uehara et al. | |
| 6,191,534 | B1 | 2/2001 | Schuler et al. | |
| 6,219,017 | B1 | 4/2001 | Shimada et al. | |
| 6,249,268 | B1 | 6/2001 | Tachibana et al. | |
| 6,337,542 | B1 | 1/2002 | Hanaki et al. | |
| 6,414,661 | B1 | 7/2002 | Shen et al. | |
| 6,456,337 | B1 | 9/2002 | Kobayashi et al. | |
| 6,473,065 | B1 * | 10/2002 | Fan | 345/82 |
| 6,501,230 | B1 * | 12/2002 | Feldman | 315/169.3 |
| 6,501,466 | B1 | 12/2002 | Yamagisiii et al. | |
| 6,518,962 | B2 | 2/2003 | Kimura et al. | |
| 6,525,683 | B1 * | 2/2003 | Gu | 341/140 |
| 6,542,260 | B1 | 4/2003 | Gann et al. | |
| 6,618,084 | B1 | 9/2003 | Rambaldi et al. | |
| 6,628,848 | B1 | 9/2003 | Nakamura | |
| 6,771,281 | B2 | 8/2004 | Takagi | |
| 6,812,651 | B2 | 11/2004 | Iwata et al. | |
| 6,897,837 | B1 | 5/2005 | Sakumoto et al. | |
| 7,053,874 | B2 | 5/2006 | Koyama | |
| 7,199,771 | B2 | 4/2007 | Yamazaki et al. | |
| 2001/0020922 | A1 | 9/2001 | Yamazaki et al. | |
| 2001/0045929 | A1 | 11/2001 | Prache et al. | |
| 2002/0030449 | A1 | 3/2002 | Okazaki et al. | |
| 2002/0033783 | A1 | 3/2002 | Koyama | |
| 2002/0047550 | A1 | 4/2002 | Tanada | |
| 2002/0089291 | A1 | 7/2002 | Kaneko et al. | |
| 2002/0101395 | A1 | 8/2002 | Inukai | |
| 2002/0105279 | A1 | 8/2002 | Kimura | |
| 2002/0180721 | A1 | 12/2002 | Kimura et al. | |
| 2003/0063053 | A1 | 4/2003 | Yamazaki et al. | |
| 2003/0063081 | A1 | 4/2003 | Kimura et al. | |
| 2003/0071804 | A1 | 4/2003 | Yamazaki et al. | |
| 2004/0008166 | A1 | 1/2004 | Kimura | |
| 2006/0202924 | A1 | 9/2006 | Koyama | |
| 2007/0097038 | A1 | 5/2007 | Yamazaki et al. | |

FOREIGN PATENT DOCUMENTS

| | | | |
|---|---|---|---|
| EP | 1 071 070 | A2 | 1/2001 |
| EP | 1 102 234 | A2 | 5/2001 |
| EP | 0 923 067 | B1 | 8/2004 |
| GB | 2 106 299 | A | 4/1983 |
| JP | 04-009996 | | 1/1992 |
| JP | 05-273939 | | 10/1993 |
| JP | 07-036410 | | 2/1995 |
| JP | 10-92576 | | 4/1998 |
| JP | 10-112391 | | 4/1998 |
| JP | 10-254410 | | 9/1998 |
| JP | 11-015437 | | 1/1999 |
| JP | 11-305722 | | 11/1999 |
| JP | 2001-056670 | | 2/2001 |
| JP | 2001-092411 | | 4/2001 |
| JP | 2001-147659 | | 5/2001 |
| WO | WO 90/13148 | | 11/1990 |
| WO | WO 01/54107 | A1 | 7/2001 |
| WO | WO 01/63587 | A2 | 8/2001 |

OTHER PUBLICATIONS

U.S. Appl. No. 09/948,091, filed Sep. 7, 2001; Shunpei Yamazaki et al., "Spontaneous Light Emitting Device and Driving Method Thereof".

Australian Patent Office Search Report for Application No. SG 200205774-3 dated Oct. 28, 2004.

Australian Patent Office Search Report for Application No. SG 200205775-0 dated Oct. 28, 2004.

T. Shimoda et al., "Current Status and Future of Light-Emitting Polymer Display Driven by Poly-Si TFT" Society for Information Display—International Symposium Digest of Technical Papers, vol. XXX, May 18-20, 1999 Digest pp. 372-375.

Tatsuya Shimoda et al.,"High Resolution Light Emitting Polymer Display Driven by Low Temperature Polysilicon Thin Film Transistor with Integrated Driver", Asia Display 1998, pp. 217-220.

Chang Wook Han et al., "Green OLED With Low Temperature Poly Si TFT". EuroDisplay—The 19th International Display Research Conference, Late-News Papers, Sep. 6-9,. 1999, pp. 27-30.

Tsutsui et al., "Electrominescence in Organic Thin Films", Photochemical Processes in Organized Molecular Systems, 1991, pp. 437-450 (Elsevier Science Publishers, Tokyo, 1991).

M. A. Baldo et al., "Highly Efficient Phosphorescent Emission from Organic Electroluminescent Devices", Nature vol. 395, Sep. 10, 1998, pp. 151-154.

M. A. Baldo et al., Very High-Efficiency Green Organic Light-Emitting Devices Based on Electrophosphorescence:, Applied Physics Letters vol. 75, No. 1, Jul. 5, 1999, pp. 4-6.

Tsutsui et al., "High Quantum Efficiency in Organic Light-Emitting Devices with Iridium-Complex as Triplet Emissive Center", Japanese Journal of Applied Physics vol. 38, Part 12B, Dec. 15, 1999, pp. L1502-L1504.

H. Shenk et al., "Polymers for Light-Emitting Diodes", Euro Display Proceedings 1999, pp. 33-37.

U.S. Appl. No. 09/948,091, filed Sep. 7, 2001 "Spontaneous Light Emitting Device And Driving Method Thereof"; Koyama et al. (Notice of Publication and Amendment Filed Sep. 6, 2005).

Australian Patent Office Search Report for Application No. SG 200205774-3 dated Jul. 12, 2005.

Tsutsui et al., "High Quantum Efficiency in Organic Light-Emitting Devices with Iridium-Complex as Triplet Emissive Center", Japanese Journal of Applied Physics vol. 38, Part.2, No. 12B, Dec. 15, 1999, pp. L1502-L1504.

U.S. Appl. No. 09/948,091; Filed: Sep. 7, 2001; "Spontaneous Light Emitting Device and Driving Method Thereof"; Koyama (Office Action dated May 3, 2005).

* cited by examiner 332
332
333
333
334
334
335
335

336b
336a
336
332b
332a
332b
337b
337a
337
333b
333a
333b
338b
338a
338
334b
334a
334b
339b
339a
339
335b
335a
335b 350
345
344
343
344
345
348
347
346
347
348

357
358
359
360
361
362
365
355
356
361
375
367
368
369
370
370
366
374:Tr2
373:Tr3
372:n-channel TFT
371:p-channel TFT
pixel portion
drive circuit

LIGHT EMITTING DEVICE AND ELECTRONIC APPARATUS USING THE SAME

BACKGROUND OF THE INVENTION

1. Field of the Invention

The present invention relates to a light emitting panel in which a light emitting element formed on a substrate is enclosed between the substrate and a cover member. Also, the present invention relates to a light emitting module in which an IC or the like is mounted on the light emitting panel. Note that, in this specification, the light emitting panel and the light emitting module are generically called light emitting devices. The present invention further relates to electronic apparatuses utilizing the light emitting devices.

2. Description of the Related Art

A light emitting element emits light by itself, and thus, has high visibility. The light emitting element does not need a backlight necessary for a liquid crystal display device (LCD), which is suitable for a reduction of a light emitting device in thickness. Also, the light emitting element has no limitation on a viewing angle. Therefore, recently, the light emitting device using the light emitting element comes under the spotlight as a display device that substitutes for a CRT or the LCD.

Incidentally, the light emitting element means an element of which a luminance is controlled by electric current or voltage in this specification. The light emitting element includes an OLED (organic light emitting diode), an MIM type electron source element (electron emitting elements) used to a FED (field emission display) and the like.

The OLED includes a layer containing an organic compound in which luminescence generated by application of an electric field (electroluminescence) is obtained (organic light emitting material) (hereinafter, referred to as organic light emitting layer), an anode layer and a cathode layer. A light emission in returning to a base state from a singlet excitation state (fluorescence) and a light emission in returning to a base state from a triplet excitation state (phosphorescence) exist as the luminescence in the organic compound. The light emitting device of the present invention may use one or both of the above-described light emissions.

Note that, in this specification, all the layers provided between an anode and a cathode of the OLED are defined as organic light emitting layers. The organic light emitting layers specifically include a light emitting layer, a hole injecting layer, an electron injecting layer, a hole transporting layer, an electron transporting layer and the like. These layers may have an inorganic compound therein. The OLED basically has a structure in which an anode, a light emitting layer, a cathode are laminated in order. Besides this structure, the OLED may take a structure in which an anode, a hole injecting layer, a light emitting layer, a cathode are laminated in order or a structure in which an anode, a hole injecting layer, a light emitting layer, an electron transporting layer, a cathode are laminated in order.

On the other hand, the decreased luminance of OLED resulting from the deterioration of the organic light emitting material poses a serious problem on the practical use of the light emitting devices.

FIG. 18A graphically illustrates a time-varying luminance of the light emitting element when a constant-current is applied between the two electrodes thereof. As shown in FIG. 18A, the luminance of the light emitting element decreases despite the application of the constant current because the organic light emitting material is deteriorated with time.

FIG. 18B graphically illustrates a time-varying luminance of the light emitting element when a constant voltage is applied between the two electrodes thereof. As shown in FIG. 18B, the luminance of the light emitting element decreases with time despite the application of the constant voltage. This is partly because, as shown in FIG. 18A, the deterioration of the organic light emitting material entails the decrease of the luminance at the constant current and partly because the current flow through the light emitting element caused by the constant voltage is decreased with time, as shown in FIG. 18C.

The decreased luminance of the light emitting element with time can be compensated by increasing the current supply to the light emitting element or increasing the voltage applied thereto. In most cases, however, an image to be displayed includes gradation levels varying from pixel to pixel so that the individual light emitting elements of the pixels are deteriorated differently, resulting in the variations of luminance. Since it is impracticable to provide each of the pixels with a power source for supplying voltage or current thereto, a common power source for supplying the voltage or current to all the pixels or a group of some pixels. Therefore, if the voltage or current supply from the common power source is simply increased to compensate for the decrease in the luminance of some light emitting elements due to deterioration, all the pixels supplied with the increased voltage or current are uniformly increased in luminance. Hence, the luminance variations among the individual light emitting elements of the pixels are not eliminated.

SUMMARY OF THE INVENTION

In view of the foregoing, it is an object of the invention to provide a light emitting device capable of suppressing the luminance variations of the OLEDs associated with the deterioration of the organic light emitting material and achieving a consistent luminance.

The light emitting device according to the invention is adapted to sample a supplied video signal constantly or periodically for sensing the light emission period or displayed gradation level of each of the light emitting elements of the pixels, so as to predict a pixel most deteriorated and decreased in luminance from the accumulations of the sensed values, or the sums of the sensed values. Then, the accumulation of the sensed values of the target pixel is compared with the previously stored data on the time-varying luminance characteristic of the light emitting element for correcting the voltage supply to the target pixel, so that a desired luminance can be achieved. At this time, an excessive voltage is supplied to the other pixels that share the common voltage source with the most deteriorated pixel. It is thus suggested that the other pixels have greater luminances than the most deteriorated pixel, displaying too high gradation levels. The other pixels are individually lowered in the gradation level by correcting the video signal for driving the pixel having the most deteriorated light emitting element, the correction of the video signal done by comparing the accumulation of the sensed values of each of the pixels with the previously stored data on the time-varying luminance characteristic of the light emitting element.

It is noted that the video signal herein is defined to mean a digital signal containing image information.

Despite the varied degrees of deterioration of the light emitting elements of the pixels, the above arrangement eliminates the luminance variations for assuring the consistent luminance of the screen and also suppresses the decrease of luminance due to deterioration.

It is noted that the value of the voltage supply from the voltage source need not necessarily be corrected based on the most deteriorated pixel but the correction may be made based on a pixel least deteriorated. In this case, a pixel having the greatest luminance due to the least deterioration is predicted from the accumulations of the sensed values of the individual pixels. Then the accumulation of the sensed values of the target pixel is compared with the previously stored data on the time-varying luminance characteristic of the light emitting element for correcting the voltage supply to the target pixel, so that a desired luminance can be achieved. At this time, an insufficient voltage is supplied to the other pixels that share the common voltage source with the pixel least deteriorated. It is thus suggested that the other pixels have lower luminances than the least deteriorated pixel, displaying too low gradation levels. The other pixels are individually increased in the gradation level by correcting the video signal for driving the pixel having the least deteriorated light emitting element, the correction of the video signal done by comparing the accumulation of the sensed values of each of the pixels with the previously stored data on the time-varying luminance characteristic of the light emitting element.

It is noted that a designer can arbitrarily define the reference pixel. As to those pixels more deteriorated than the reference pixel, the video signal may be so corrected as to increase the gradation levels of the pixels. As to those pixels less deteriorated than the reference pixel, the video signal may be so corrected as to lower the gradation levels of the pixels.

DESCRIPTION OF THE PREFERRED EMBODIMENTS

Figure 1:
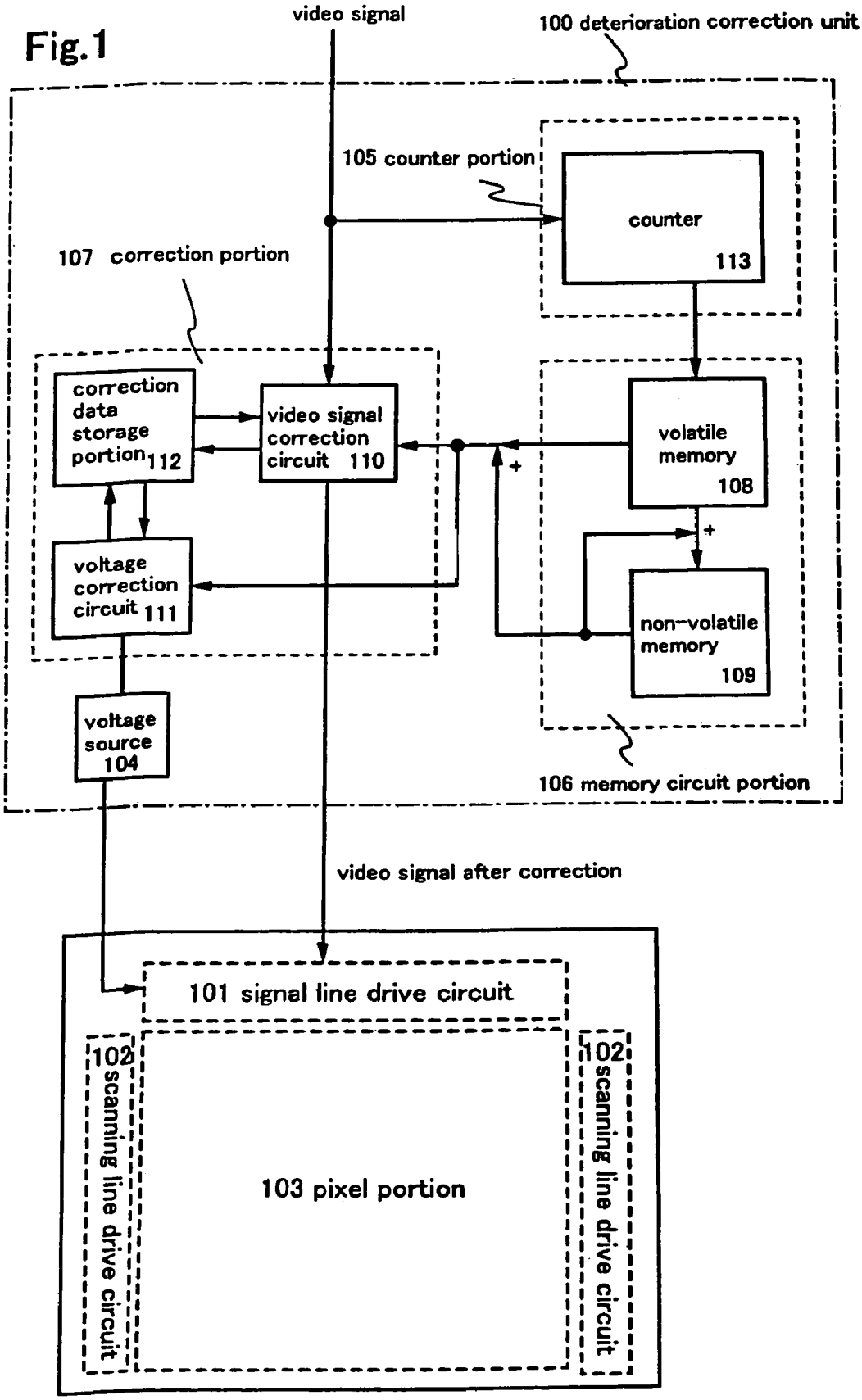
FIG. 1 is a block diagram showing a light emitting device according to the invention.

An arrangement of a light emitting device according to the invention will hereinbelow be described. FIG. 1 is a block diagram showing a light emitting device according to the invention, which includes a deterioration correction unit 100, a signal line drive circuit 101, a scanning line drive circuit 102, a pixel portion 103, and a voltage source 104. In this embodiment, the deterioration correction unit-100 and the voltage source 104 is formed on a different substrate from a substrate where signal line drive circuit 101, scanning line drive circuit 102 and pixel portion 103 are formed. If possible, however, all these elements may be formed on a single substrate. Although the voltage source 104 is included in the deterioration correction unit 100 according to this embodiment, the invention is not limited to this arrangement. The location of the voltage source 104 varies depending upon the pixel configuration but it is critical to assure that the voltage source is connected in a manner to permit the control of the magnitude of a voltage supplied to a light emitting element.

The pixel portion 103 includes a plurality of pixels each having a light emitting element. The deterioration correction unit 100 processes a video signal supplied to the light emitting device to correct a voltage supplied from the voltage source 104 to the individual light emitting elements of the pixels and to correct the video signal supplied to the signal line drive circuit in order that the individual light emitting elements of the pixels may present a consistent luminance. The scanning line drive circuit 102 sequentially selects the pixels provided at the pixel portion 103 whereas the signal line drive circuit 101 responds to a corrected video signal inputted thereto to supply a voltage to a pixel selected by the scanning line drive circuit 102.

The deterioration correction unit 100 comprises a counter portion 105, a memory circuit portion 106 and a correction portion 107. The counter portion 105 includes a counter 113. The memory circuit portion 106 includes a volatile memory 108 and a non-volatile memory 109 whereas the correction portion 107 includes a video signal correction circuit 110, a voltage correction circuit 111 and a correction data storage portion 112.

Next, description is made on the operations of the deterioration correction unit 100. First, data on a time-varying luminance characteristic of the light emitting element employed in the light emitting device are previously stored in the correction data storage portion 112. The data, which will be described hereinlater, are mainly used for the correction of the voltage supplied from the voltage source 104 to each of the pixels as well as for the correction of the video signal, the corrections performed according to the degree of deterioration of the respective light emitting elements of the pixels.

Subsequently, video signals supplied to the light emitting element are constantly or periodically (at time intervals of 1 second, for instance) sampled while the counter 113 counts respective light emission periods or gradation levels of the individual light emitting elements of the pixels based on the information of the video signals. The light emission periods or gradation levels of the individual pixels thus counted are used as data, which are sequentially stored in the memory circuit portion 106. It is noted here that since the light emission periods or gradation levels need be stored in an accumulative manner, the memory circuit portion 106 may preferably comprise a non-volatile memory. However, in general, the non-volatile memory is limited in the number of writings and hence, an arrangement may be made such that the volatile memory 108 is operated to store the data during the operation of the light emitting device while the data are written to the non-volatile memory 109 at regular time intervals (at time intervals of 1 hour or at the shutdown of the power source, for instance).

Examples of a usable volatile memory include, but are not limited to, static memories (SRAM), dynamic memories (DRAM), ferroelectric memories (FRAM) and the like. That is, the volatile memory may comprise any type of memory. Likewise, the non-volatile memory may also comprise any of the memories generally used in the art, such as a flash memory. It is noted, however, that in a case where DRAM is employed as the volatile memory, a need exists for adding a periodical refreshing function.

The accumulative data on the light emission periods or gradation levels stored in the volatile memory 108 or the non-volatile memory 109 are inputted to the video signal correction circuit 110 and the voltage correction circuit 111.

The voltage correction circuit 111 grasps a degree of deterioration of each of the pixels by comparing the data on the time-varying luminance characteristic previously stored in the correction data storage portion 112 with the accumulative data on the light emission periods or gradation levels of each of the pixels, which are stored in the memory circuit portion 106. The voltage correction circuit thus detects a particular pixel suffering the greatest deterioration, and then corrects the value of the voltage supply from the voltage source 104 to the pixel portion 103 based on the degree of deterioration of the particular pixel. Specifically, the voltage value is increased so as to permit the particular pixel to display a desired gradation level.

Since the value of the voltage supply to the pixel portion 103 is corrected based on the particular pixel, the light emitting elements of the other pixels, which are not so much deteriorated as the particular pixel, are supplied with an excessive voltage, thus failing to accomplish a desired gradation level. Therefore, the video signal correction circuit 110 corrects the video signal for determining the gradation levels of the other pixels. In addition to the accumulative data on the light emission periods or gradation levels, the video signals are inputted to the video signal correction circuit 110. The video signal correction circuit 110 grasps a degree of deterioration of each of the pixels by comparing the data on the time-varying luminance characteristic previously stored in the correction data storage portion 112 with the accumulative data on the light emission periods or gradation levels of each pixel. Thus, the correction circuit detects a particular pixel suffering the greatest deterioration and corrects the input video signal based on the degree of deterioration of the particular pixel. Specifically, the video signal is so corrected as to obtain a desired gradation level. The corrected video signal is inputted to the signal line drive circuit 101.

It is noted that the particular pixel may not be the one that suffers the greatest deterioration but may be a pixel with the least deterioration or a pixel arbitrarily determined by a designer. Whatever pixel may be selected, the video signal is corrected in the following manner. That is, a value of the voltage supplied from the voltage source 104 to the pixel portion 103 is decided based on the selected pixel. As to a pixel more deteriorated than the selected pixel, the video signal is so corrected as to increase the gradation level. As to a pixel less deteriorated than the selected pixel, on the other hand, the video signal is so corrected as to decrease the gradation level.

Figure 2:
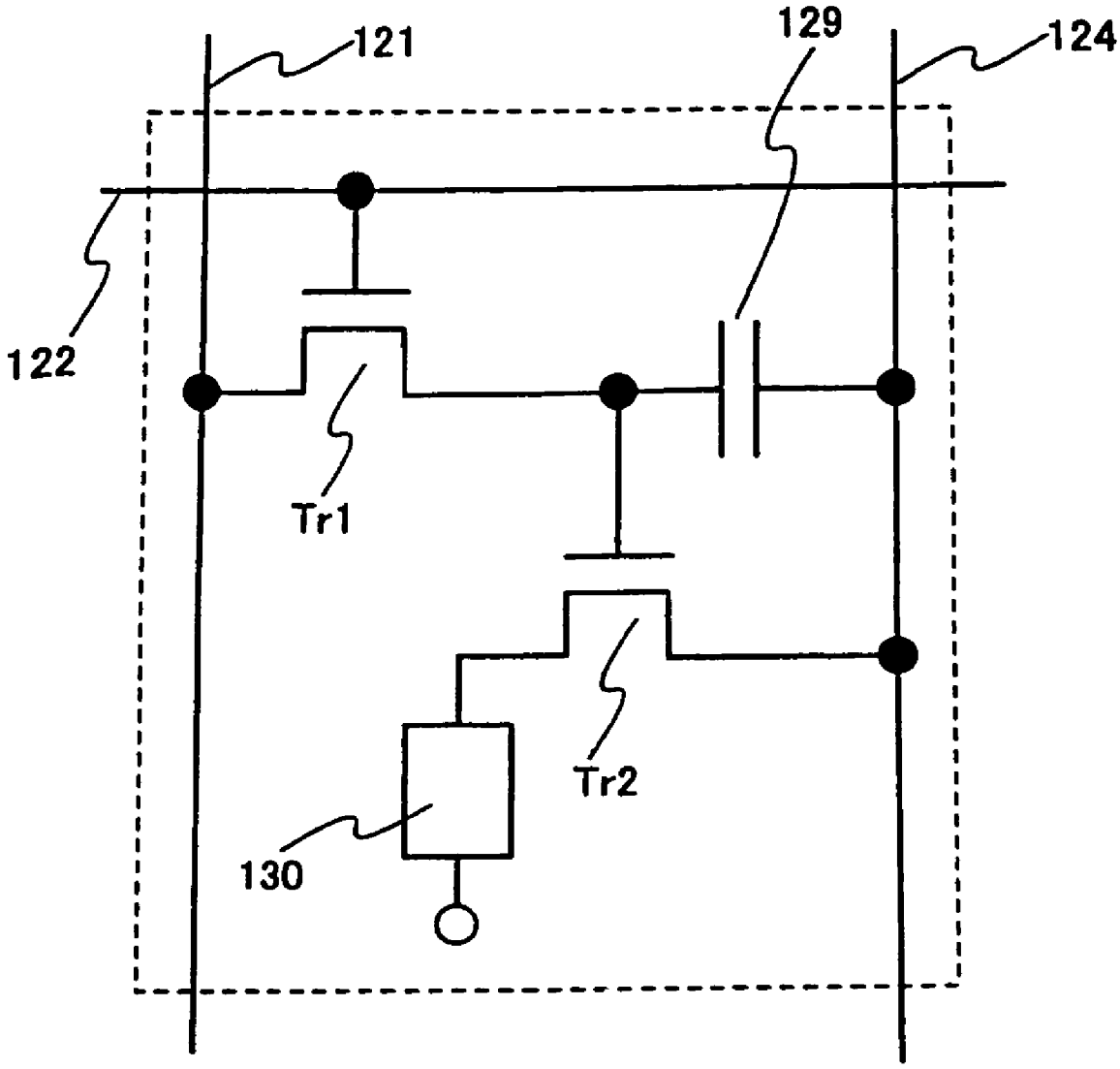
FIG. 2 is a diagram showing a pixel circuit of the light emitting device according to the invention.

FIG. 2 shows an example of the pixel included in the light emitting device according to the invention. The pixel of FIG. 2 includes a signal line 121, a scanning line 122, a power line 124, transistors Tr1, and Tr2, a capacitance 129 and a light emitting element 130.

A gate of the transistor Tr1 is connected to the scanning line 122. Tr1 has its source connected to the signal line 121 and its drain connected to a gate of the transistor Tr2. The transistor Tr2 has its source connected to the power line 124 and its drain connected to a pixel electrode of a light emitting element 130. The capacitance 129 is connected between the gate and source of the transistor Tr2 for retaining a voltage across the gate and source of the transistor Tr2. Predetermined potentials are applied to the power line 124 and a cathode of the light emitting element 130 such that the power line and the cathode have a potential difference therebetween.

A predetermined voltage from the voltage source 104 is applied to the power line 124.

The scanning line 122 is selected by a voltage applied from the scanning drive circuit 102, therefore, Tr1 becomes ON. Incidentally, there is a plurality of pixels prepared in the pixel portion 103, also, there are a plural of scanning lines 122 prepared. A plural of scanning lines 122 are serially selected, and selection duration does not overlap with each other.

When Tr1 becomes ON, the video signal voltage applied through the signal drive circuit 101 is applied to the gate of Tr2. A gate voltage $V_G$s is retained in the capacitance 129.

When the scanning lines 122 are selected, there are two methods of how to define the value of the voltage applied to the power line 124. One of which is a magnitude held at a level so that the light emitting element 130 doesn't emit light when the voltage is applied to the pixel electrode of the light emitting element 130. The other is a magnitude held at a level high enough to allow the light emitting element 130 emits light when the voltage is applied to the pixel electrodes of the light emitting element 130. The former one, when the scanning lines 122 are selected, the light emitting element does not emit light. For the latter one, when the scanning lines 122 are selected, the light emitting element emits light. Either method of applying voltage may be used, in the specification, the former one is used to describe in the present Embodiment as an example.

When the selection of the scanning lines are completed, the voltage of power line 124 is held at a level high enough to allow the light emitting element 130 to emit light when the voltage is applied to the pixel electrode of the light emitting element 130. At this time, the drain current of Tr2 is determined in accordance with the voltage of video signal input and the voltage of power line 124, the light emitting element 130 receives the drain current and emits light.

In addition, for the later one, the voltage applied to the power line 124 is held at a level high enough to allow the light emitting element to emit light all the time if the voltage is applied to the pixel electrode.

According to the light emitting device of the invention, the magnitude of the voltage supplied from the voltage source 104 to the power line 124 is corrected by means of the voltage correction circuit 111. In a case where the video signal is digital, the voltage inputted to the pixel as the video signal has only two values and hence, the video signal correction circuit 110 so corrects the video signal as to change the length of the light emission period of the light emitting element 130 for the purpose of controlling the gradation level of the pixel. In a case where the video signal is analog, the gradation level of the pixel is controlled by means of the video signal correction circuit 110 which so corrects the video signal as to change the magnitude of the drain current of Tr2.

Figure 3A:
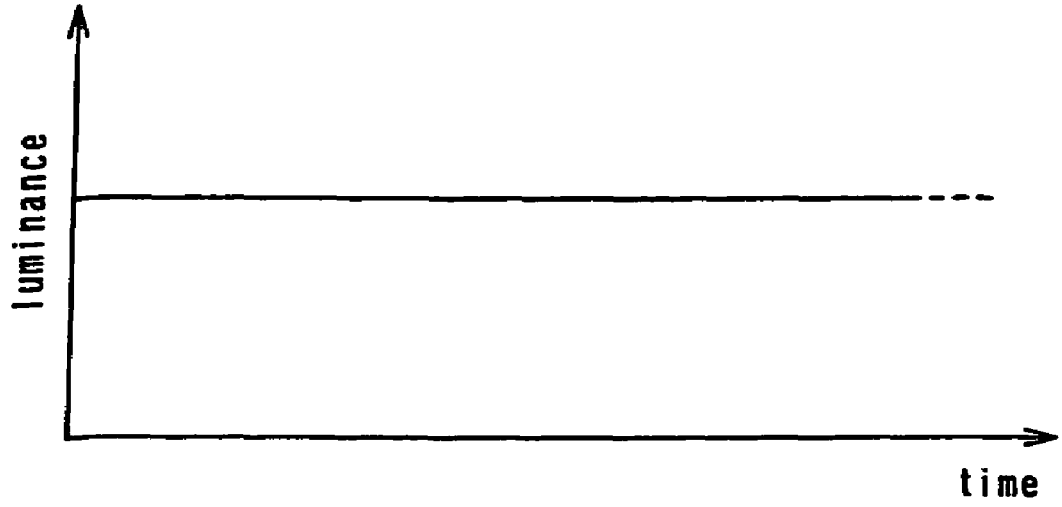
FIGS. 3A and 3B are graphs illustrating a relation between the voltage through a light emitting element and the time-varying luminance thereof according to the light emitting device of the invention.
Figure 3B:
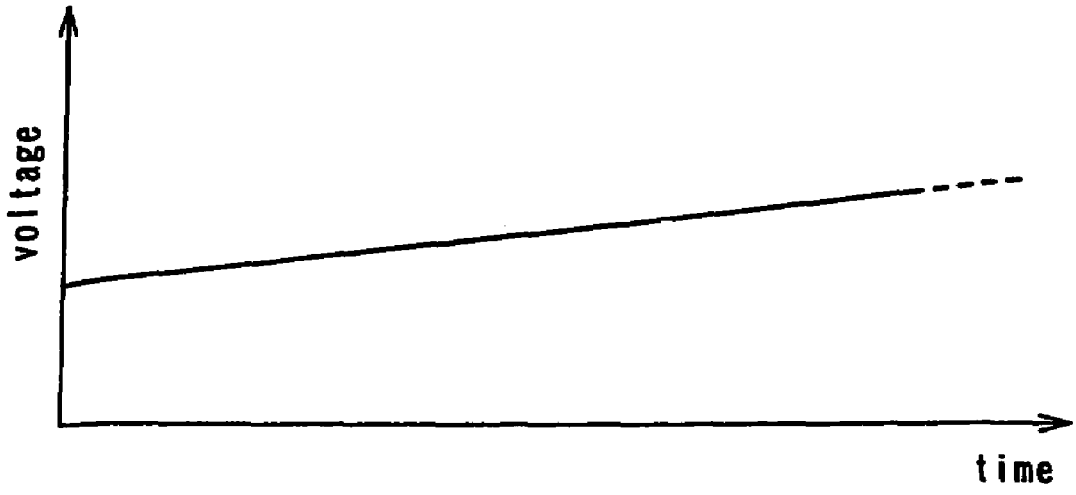

FIG. 3A shows a time-varying luminance of the light emitting element included in the light emitting device of the invention. By virtue of the above correction, the luminance of the light emitting element is maintained at a constant level. FIG. 3B shows a time-varying of a voltage applied to the light emitting element included in the light emitting device of the invention. The voltage applied to the light emitting element is increased for compensation of the decrease in luminance associated with deterioration.

In FIGS. 3A and 3B, the correction is performed to maintain the luminance of the light emitting element at a constant level at all times. However, in a case where the correction is performed at given time intervals, for example, the luminance is not always maintained at a constant level because the correction is performed at a time when the luminance of the light emitting element is lowered to some degree.

Figure 4:
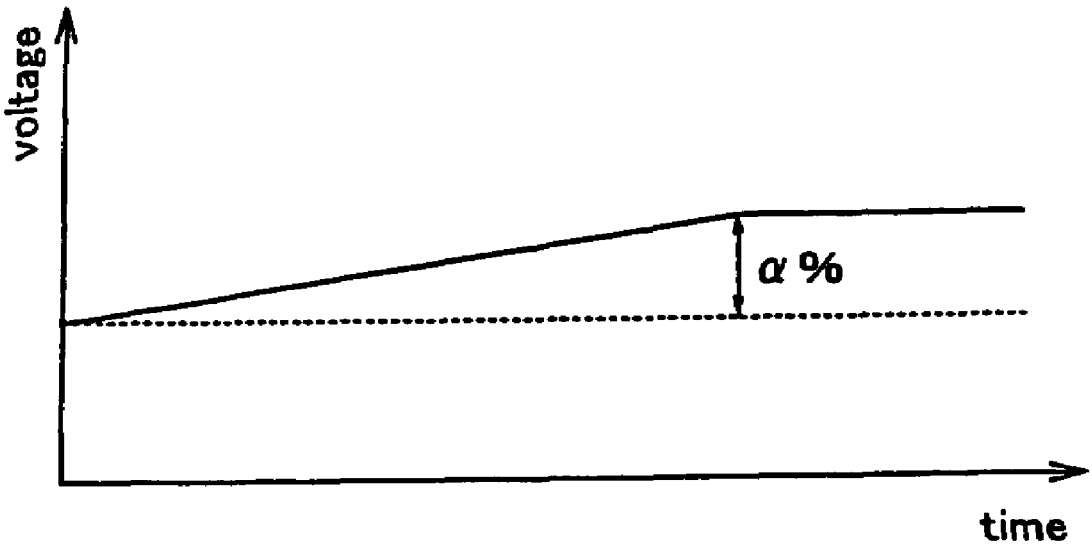
FIG. 4 is a graph representing the time-varying amount of voltage through the light emitting element of the light emitting device according to the invention.

With advance of the deterioration of the light emitting element, the voltage applied to the light emitting element is infinitely increased. An excessively great voltage applied to the light emitting element speeds up the deterioration thereof, promoting the occurrence of a non-emitting spot (dark spot). Therefore, as shown in FIG. 4, the invention may be arranged such that the increase of the voltage by the correction is suspended when the voltage applied to the light emitting element is increased by a given value ($\alpha$ %) from an initial value and then, the voltage supply from the voltage source to the light emitting element may be maintained at a constant level.

It is noted that the pixel of the light emitting device of the invention is not limited to the configuration shown in FIG. 2. The pixel of the invention may have any configuration that permits the voltage applied to the light emitting element to be controlled by means of the voltage source.

According to the light emitting device of the invention, when the power is shut down, the accumulative data representing the light emission periods or gradation levels of the individual pixels and stored in the volatile memory 108 may be added to the accumulative data on the light emission periods or gradation levels, which are stored in the non-volatile memory 109, and the resultant data may be stored in the non-volatile memory. This permits the collection of the accumulative data on the light emission periods or gradation levels of the light emitting elements to be continued after the subsequent power-up.

In the aforementioned manner, the light emission periods or gradation levels of the light emitting elements are constantly or periodically sensed while the accumulative data on the light emission periods or gradation levels are stored for comparison with the previously stored data on the time-varying luminance characteristic of the light emitting elements, so that the video signal may be corrected on an as-needed basis. This permits the video signal to be corrected such that a deteriorated light emitting element can achieve an equivalent luminance to that of an undeteriorated light emitting element. As a result, the variations in luminance are prevented and a consistent screen display is assured.

Although the light emission periods or gradation levels of the individual light emitting elements are sensed according to the embodiment of the invention, an arrangement may be made such that only the presence or absence of light emission from the individual light emitting elements is determined at some point of time. The detection of the presence of light emission from the individual light emitting elements is repeated in cycles so that the degree of deterioration of each light emitting element can be estimated from a ratio of the number of light emissions therefrom versus the total count of detections.

According to FIG. 1, the corrected video signal is directly inputted to the signal line drive circuit. In a case where the signal line drive circuit is adapted for an analog video signal, a D/A converter circuit may be provided such that the digital video signal is converted to an analog signal before inputted.

Although the foregoing description is made by way of an example where OLED is employed as the light emitting element, the light emitting device of the invention does not exclusively employ OLED but may employ any other light emitting elements such as PDP, FED and the like.

EXAMPLES

Examples of the invention will be described as below.

Example 1

In this example, description is made on a method for correcting the video signal which is adopted by the correction portion of the light emitting device according to the invention.

In one approach to complement the decreased luminance of the deteriorated light emitting element on the basis of a signal, a given correction value is added to an input video signal to convert the input signal to a signal practically representing a gradation level increased by several steps thereby achieving a luminance equivalent to that prior to the deterioration. The simplest way to implement this approach in circuit design is to provide a circuit in advance which is capable of processing data on an extra gradation level.

Specifically, in the case of a light emitting element adapted for 6-bit digital gradations (64 gradation levels) and including the deterioration correction function of the invention, for example, the device is so designed and manufactured as to have an additional capability of processing an extra 1 bit data for performing the correction and to practically process 7-bit digital gradations (128 gradation levels). Then, the device operates on the lower order 6-bit data in normal operation. When the deterioration of the light emitting element occurs, the correction value is added to the normal video signal and the aforesaid extra 1-bit is used for processing the signal of the added value. In this case, MSB (most significant bit) is used for the signal correction alone so that practically displayed gradation comprises 6 bits.

Example 2

In this example, description is made on a method for correcting the video signal in a different way from that of Example 1.

Figure 5A:
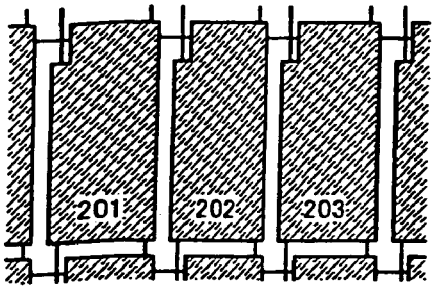
FIGS. 5A to 5C are diagrams illustrating a correction method based on an adding operation.
Figure 5B:
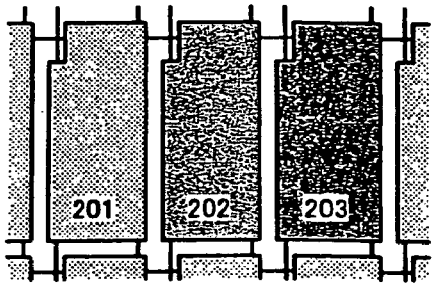

FIG. 5A is an enlarged view showing the pixel portion 103 of FIG. 1. Here, three pixels 201 to 203 are discussed. It is assumed that the pixel 201 suffers the least deterioration, the pixel 202 suffering a greater deterioration than the pixel 201, the pixel 203 suffering the greatest deterioration.

The greater the deterioration of the pixel, the greater the decrease of luminance of the pixel. Without the correction of luminance, the pixels, which are displaying a certain half tone, will encounter luminance variations as shown in FIG.

5B. That is, the pixel 202 presents a lower luminance than the pixel 201 whereas the pixel 203 presents a much lower luminance than the pixel 201.

Next, actual correction operations are described. Measurement is previously taken to obtain a relation between the accumulative data on the light emission periods or gradation levels of the light emitting element and the decrease in the luminance thereof due to deterioration. It is noted that the accumulative data on the light emission periods or gradation levels and the decrease in the luminance of the light emitting element due to deterioration do not always present a simple relation. The degrees of deterioration of the light emitting element versus the accumulative data on the light emission periods or gradation levels are stored in the correction data storage portion 112 in advance.

The voltage correction circuit 111 determines a correction value for the voltage supply from the voltage source 104 based on the data stored in the correction data storage portion 112. The correction value for the current is determined based on the accumulative data on the light emission periods or gradation levels of a reference pixel. If the pixel 203 with the greatest deterioration is used as reference for example, the pixel 203 is allowed to attain a desired gradation level but the pixels 201 and 202 are applied with an excessive voltage so that a video signal therefor requires correction. Thus, the video signal correction circuit 110 so corrects the input video signal as to achieve the desired, gradation levels based on the degree of deterioration of the particular pixel having the greatest deterioration. Specifically, the accumulative data on the light emission periods or gradation levels are compared between the reference pixel and another pixel; a difference between the gradation levels of these pixels is calculated; and the video signal is so corrected as to compensate for the gradation level difference.

Referring to FIG. 1, the video signal is inputted to the video signal correction circuit 110, which reads out the accumulative data on the light emission periods or gradation levels of each of the pixels, the accumulative data stored in the memory circuit portion 106. The video signal correction circuit decides a correction value for each video signal by comparing the read accumulative data on the light emission periods or gradation levels of each of the pixels with the degrees of deterioration of the light emitting element associated with the accumulative data on the light emission periods or gradation levels thereof, the degrees of deterioration stored in the correction data storage portion 112.

In a case where the correction is performed using the pixel 203 as reference, for example, the pixels 201 and 202 differ from the pixel 203 in the degree of deterioration, thus requiring the correction of the gradation levels by way of the video signal. It is expected from the accumulative data on the light emission periods or gradation levels of these pixels that the pixel 201 has a greater difference from the pixel 203 in the degree of deterioration than the pixel 202 does. Hence, the gradation level of the pixel 203 is corrected by a greater number of steps as compared with the correction for the pixel 202.

Figure 5C:
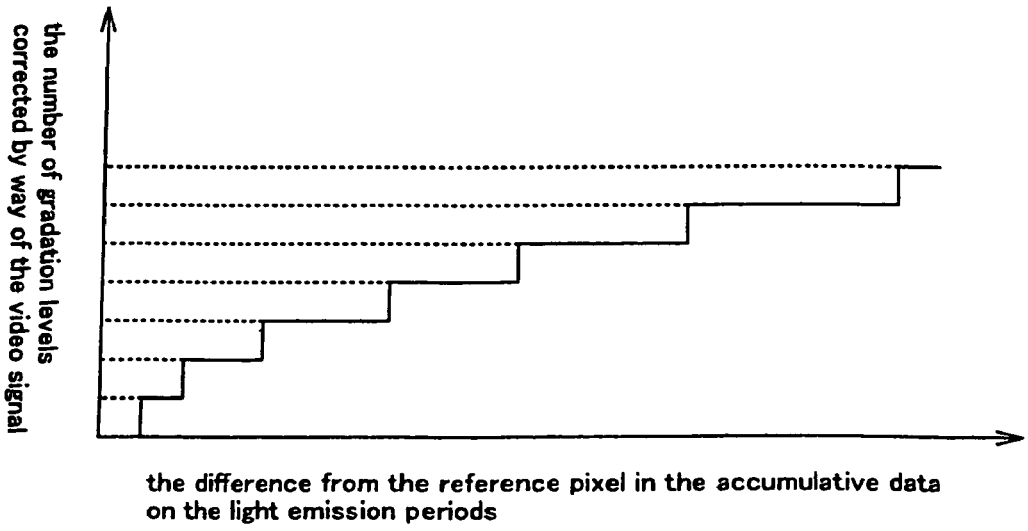

FIG. 5C graphically shows a relation between the difference from the reference pixel in the accumulative data on the light emission periods or gradation levels and the number of gradation levels corrected by way of the video signal. It is noted that since the accumulative data on the light emission periods or gradation levels and the decrease in the luminance of the light emitting element due to deterioration do not always have a simple relation, the number of gradation levels to be added by the correction of the video signal does not always present a simple relation against the accumulative data on the light emission periods or gradation levels. As described above, the correction based on the adding operation assures the consistent luminance of screen.

Figure 17:
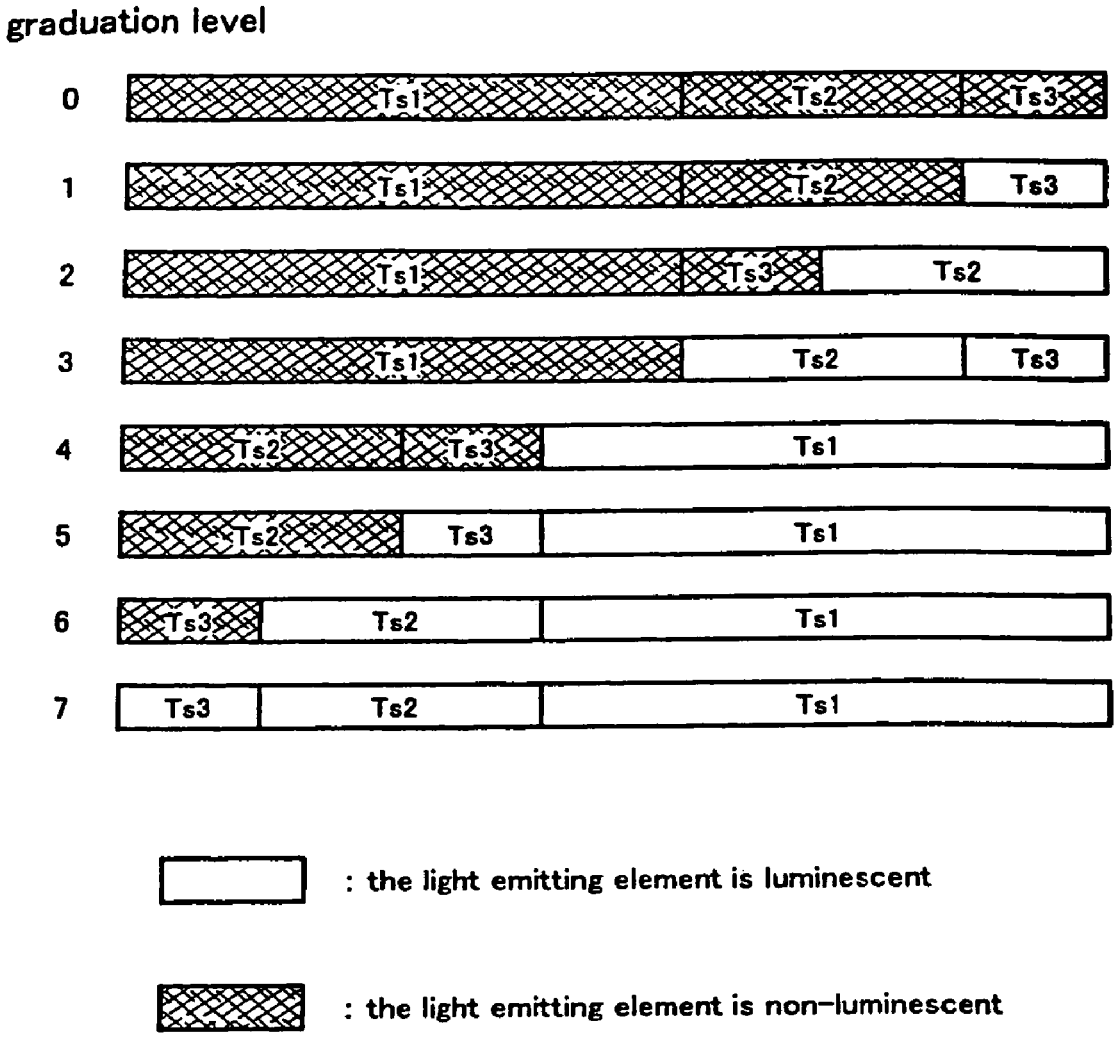
FIG. 17 is a graph representing a relation between the gradation level and the light emission period.

Now referring to FIG. 17, description is made on a relation between the respective lengths of the light emission periods (Ts) of the light emitting elements corresponding to the respective bits of the video signal and the gradation level of the light emitting device of the invention. FIG. 17 takes an example where the video signal consists of 3 bits and illustrates the durations of light emissions appearing in one frame period for displaying each of the 8 gradation levels of 0 to 7.

The individual bits of the 3-bit video signal correspond to three light emission periods Ts1 to Ts3, respectively. The arrangement of the light emission periods is expressed as Ts1:Ts2:Ts3=$2^2$:2:1. Although the example is explained by way of the example of the 3-bit video signal, the number of bits is not limited to this. In a case where an n-bit video signal is used, the ratio of the lengths of the light emission periods is expressed as Ts1:Ts2: . . . :Tsn-1:Tsn=$2^{n-1}$:$2n^{n-2}$: . . . 2:1.

The gradation level is determined by the sum of the lengths of the durations of light emissions appearing in one frame period. In a case where the light emitting elements are luminescent for all the light emission periods, for example, the gradation level is at 7. Where the light emitting elements are non-luminescent for all the light emission periods, the gradation level is at 0.

It is assumed that the voltage is corrected in order to permit the pixels 201, 202 and 203 to display a gradation level 3, but that the pixel 203 achieves the gradation level 3 whereas the pixel 201 displays a gradation level 5 and the pixel 202 displays a gradation level 4. In this case, the gradation level of the pixel 201 is 2 steps higher, whereas the gradation level of the pixel 202 is 1 step higher.

Thus, the video signal correction circuit corrects the video signal to apply the pixel 201 with a corrected video signal of a gradation level 1 which is 2 steps lower then the desired gradation level 3, such that the light emitting element thereof may emit light only for the period of Ts3. On the other hand, the video signal correction circuit corrects the video signal to apply the pixel 202 with a corrected video signal of a gradation level 2 which is 1 step lower than the desired gradation level 3, such that the light emitting element thereof emits light only for the period of Ts2.

Although this example illustrates the case where the correction is performed using the pixel with the greatest deterioration as reference, the invention is not limited to this. The designer may arbitrarily define the reference pixel and may arrange such that the video signal is corrected on an as-needed basis to accomplish coincidence of the gradation level with that of the reference pixel.

In a case where a pixel with the least deterioration is used as reference, the video signal is corrected based on the addition so that the correction on the display of white is ineffective. (Specifically, when "111111" is inputted as a 6-bit video signal, for example, any further addition cannot be done.) On the other hand, in a case where a pixel with the greatest deterioration is used as reference, the video signal is corrected based on subtraction. In contrast to the correction based on addition, an ineffective range of correction is for the display of black and hence, there is little influence. (Specifically, when "000000" is inputted as a 6-bit video signal, any further subtraction is not needed and an exact display of black can be accomplished by a normal light emitting element and a deteriorated light emitting element (simply by placing the light emitting elements in a non-emission state). The method has a feature that spots of some step higher gradation levels than 0 neighboring a black spot can be substantially adequately displayed if a display unit is adapted to display data of a somewhat large number of bits.) Both the methods are useful for increasing the number of gradation-levels.

In an another effective approach, both the correction method based on addition and the correction method based on subtraction are used in combination as switched at a given gradation level as boundary, for example, thereby compensating each other for the respective demerits thereof.

Example 3

In Example 3, the following description refers to the configurations of a signal line drive circuit and a scanning line drive circuit provided for the light emitting device of the present invention.

Figure 6A:
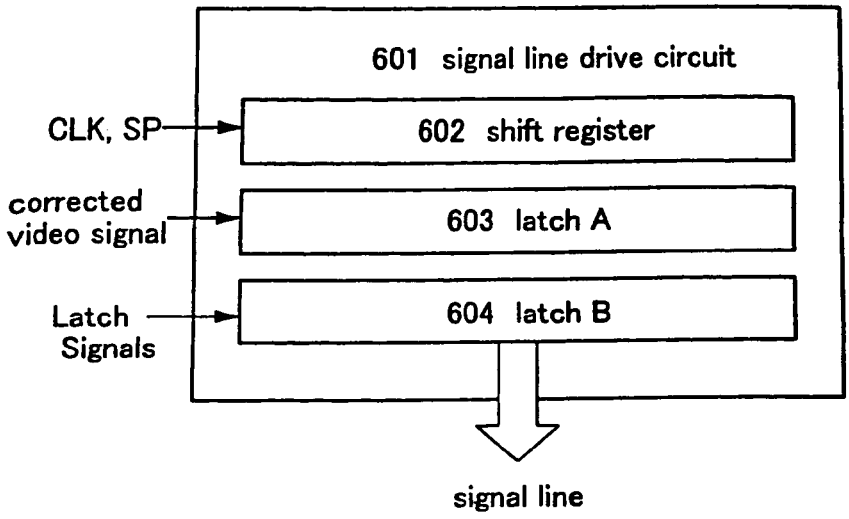
FIGS. 6A and 6B are block diagrams showing a signal line drive circuit of the light emitting device according to the invention.
Figure 6B:
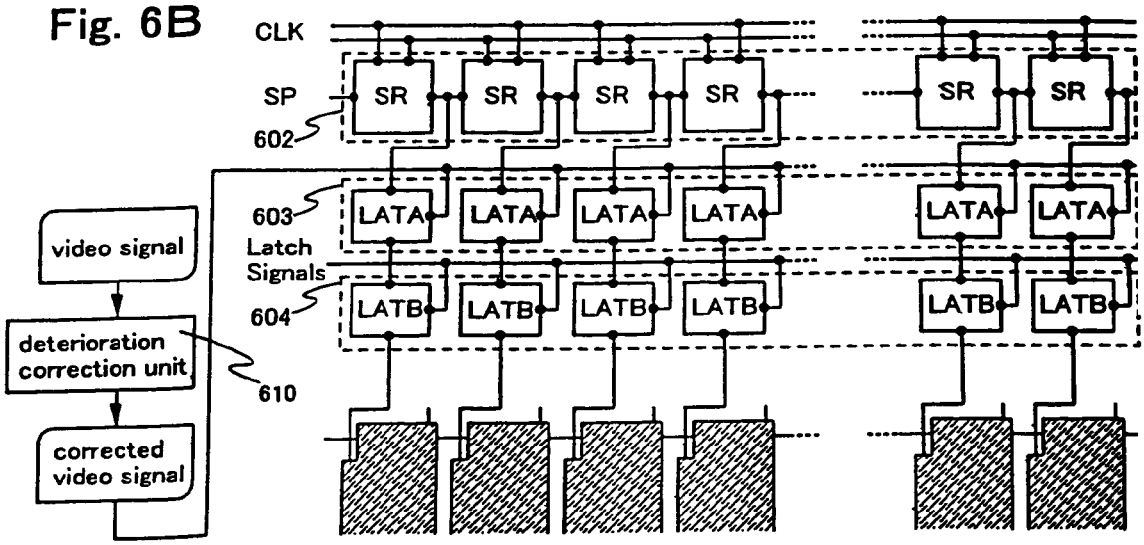

The block figure of a drive circuit in a light emitting device with respect to this example is shown in FIGS. 6A and 6B. FIG. 6A shows the signal line drive circuit 601, which has a shift register 602, a latch (A) 603, and a latch (B) 604.

FIG. 6B shows a further detailed configuration of the signal line drive circuit shown in FIG. 6A.

A clock signal CLK and a start pulse SP are input to the shift register 602 in the signal line drive circuit 601. The shift register 602 generates timing signals in order based upon the clock signal CLK and the start pulse SP, and supplies the timing signals one after another to the subsequent stage circuit through the buffer (not illustrated) and the like.

Note that, the timing signals output from the shift register circuit 602 may be buffer amplified by a buffer and the like. The load capacitance (parasitic capacitance) of a wiring to which the timing signals are supplied is large because many of the circuits or elements are connected to the wiring. The buffer is formed in order to prevent bluntness in the rise and fall of the timing signal, generated due to the large load capacitance. In addition, the buffer is not always necessary provided.

The timing signal buffer amplified by a buffer is inputted to the latch (A) 603. The latch (A) 603 has a plurality of latch stages for processing corrected video signals in a deterioration correction unit 610. The latch (A) 603 gradually writes in and maintains the corrected video signals input from the deterioration correction unit 610, when the timing signal is input.

Note that the video signals may also be input in order to the plurality of latch stages of the latch (A) 603 in writing in the video signals to the latch (A) 603. However, the present invention is not limited to this structure. The plurality of latch stages of the latch (A) 603 may be divided into a certain number of groups, and the video signals may be input to the respective groups at the same time in parallel, performing partitioned driving. Also, the number of the stages included in one group is referred to as dividing number. For example, when the latches are divided into groups every four stages, it is referred to as partitioned driving with 4 divisions.

The period during which the video signals is completely written into all of the latch stages of the latch (A) 603 is referred to as a line period. In practice, there are cases in which the line period includes the addition of a horizontal return period to the above line period.

One line period is completed, the latch signal is inputted to the latch (B) 604. At the moment, the video signals written into and stored in the latch (A) 603 are send all together to be written into and stored in all stages of the latch (B) 604.

In the latch (A) 603 after completing sending the digital video signal to the latch (B) 604, it is performed to write into the digital video signal in accordance with the timing signal from the shift resister 602. In the second ordered one line period, the digital video signal that is written into and stored in the latch (B) 604 is inputted to the source signal line.

In place of a shift register, it is also practicable to utilize a different circuit like a decoder circuit to serially write in video signal to latch circuit.

Figure 7:
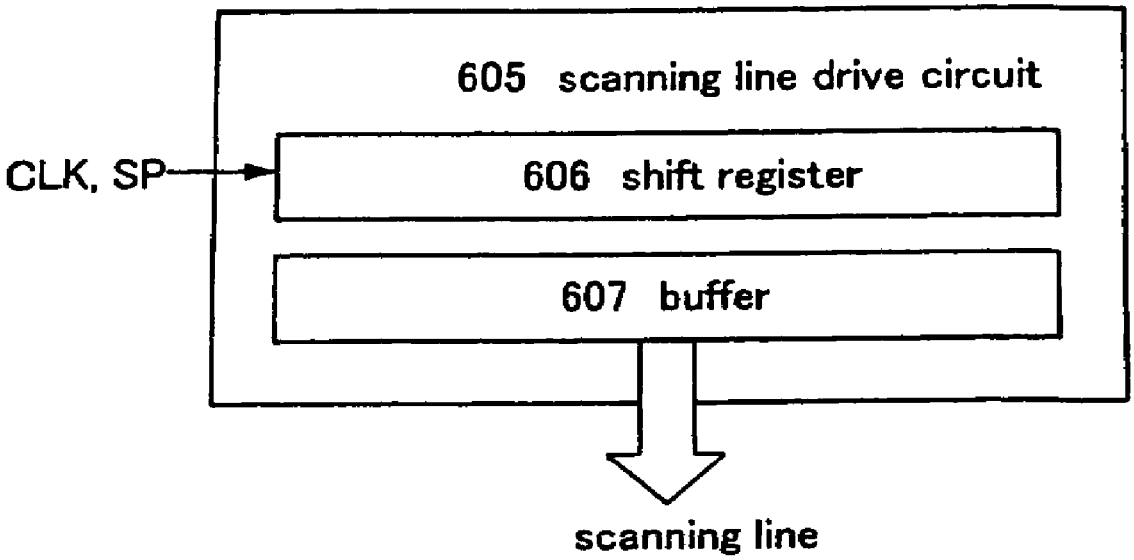
FIG. 7 is a block diagram showing scanning line drive circuit of the light emitting device according to the invention.

FIG. 7 exemplifies a block diagram of a scanning line drive circuit comprising a shift register 606 and a buffer circuit 607. If deemed necessary, a level shifter may also be provided.

In the scanning line drive circuit 605, the timing signal from the register 606 is input to the buffer circuit 607 and delivered to a corresponding scanning line. A plurality of gates of those TFTs functioning as switch elements composing pixels corresponding one-line are connected to individual scanning lines. Since it is required to simultaneously turn ON a plurality of TFTs included in pixels corresponding to one line, the buffer circuit 607 is capable of accommodating flow of a large current.

In place of a shift register, it is also practicable to utilize a different circuit like a decoder circuit to select gate signals and provide timing signals.

The configuration of the drive circuit utilized in the present invention is not solely limited to the one shown in Example 3. The configuration based on this example may also be realized by being freely combined with Example 1 or 2.

Example 4

In the light emitting device according to the embodiment of the invention, the deterioration correction unit is formed on a different substrate from the substrate where the pixel portion is provided. The video signal supplied to the light emitting device is subjected to the correction in the video signal correction circuit and then inputted to the signal line drive circuit via FPC (flexible printed circuit), the signal line drive circuit formed on the same substrate that includes the pixel portion. The merit of such a method is that the deterioration correction unit features compatibility by virtue of the unit design, thus permitting the direct use of a general light emitting panel. This example illustrates an approach where the deterioration correction unit is formed on the same substrate that includes the pixel portion, the signal line drive circuit and the scanning line drive circuit, thereby achieving the cost reduction because of a notably decreased number of components, the space saving and the high speed operation.

Figure 8:
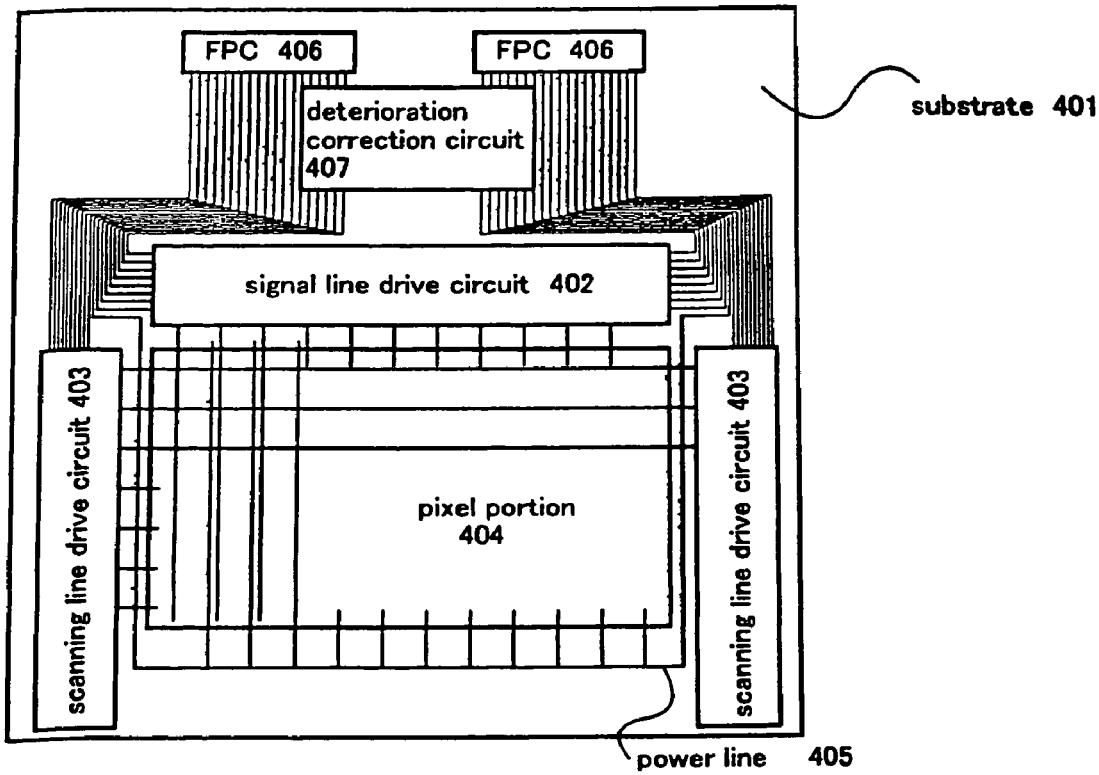
FIG. 8 is a block diagram showing a light emitting device according to the invention.

FIG. 8 shows an arrangement of light emitting device according to the invention wherein the deterioration correction unit as well as the pixel portion, signal line drive circuit and scanning line drive circuit are integrally formed on the same substrate. A signal line drive circuit 402, a scanning line drive circuit 403, a pixel portion 404, a power line 405, an FPC 406 and a deterioration correction unit 407 are integrally formed on a substrate 401. Needless to say, a layout on the substrate is not limited to the example shown in the figure. However, it is favorable that the individual blocks are arranged in close adjacency with one another with the layout of the signal line and the like or the wiring length thereof taken into consideration.

The video signal from an external image source is inputted to the video signal correction circuit of the deterioration correction unit 407 via the FPC 406. Subsequently, the corrected video signal is inputted to the signal line drive circuit 402.

In the voltage correction circuit of the deterioration correction unit, on the other hand, an amount of voltage outputted from a voltage source is corrected. According to the example, the amount of voltage output from the voltage source in the deterioration correction unit is corrected by means of the voltage correction circuit, but the example is not solely limited to this arrangement. The voltage source for the control of the amount of voltage applied to the light emitting element is not always necessary to be disposed in the deterioration correction unit.

In the example shown in FIG. 8, the deterioration correction unit 407 is disposed between the FPC 406 and the signal line drive circuit 402 so that the routing of a control signal is facilitated.

This example may be practiced in combination with any of Examples 1 to 3.

Example 5

In Example 5, the configuration of pixels included in the light emitting device of the present invention is described with reference to a circuit diagram shown in FIG. 9.

Figure 9:
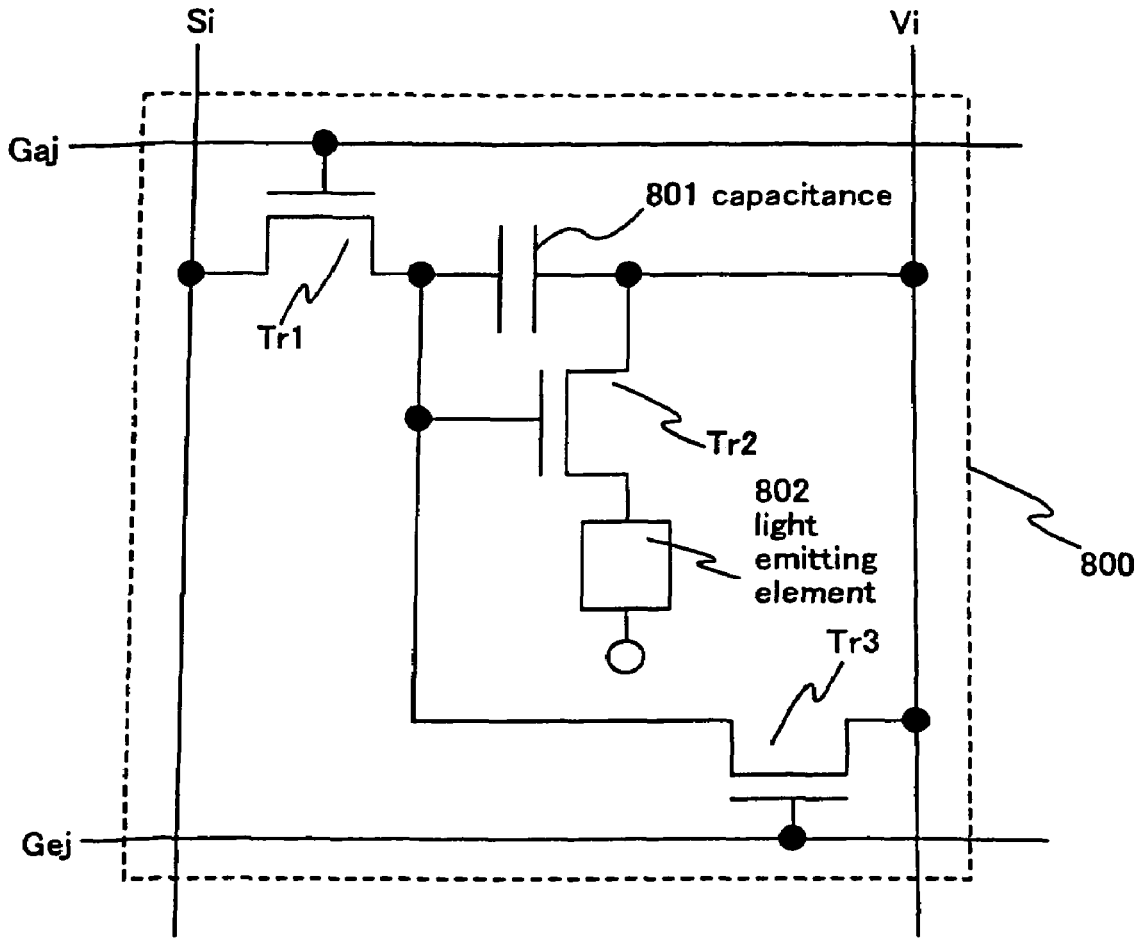
FIG. 9 is a diagram showing a pixel circuit of the light emitting device according to the invention.

A pixel 800 according to the example shown in FIG. 9 includes a signal line Si (one of S1 to Sx), a power line Vi (one of V1 to Vx) which connects to a voltage source, a first scanning line Gaj (one of Ga1 to Gay), and a second scanning line Gej (one of Ge1 to Gey).

The pixel 800 further includes transistors Tr1, Tr2, and Tr3, a capacitance 801 and a light emitting element 802. A gate of Tr1 is connected to the first scanning line Gaj. For a source and a drain of Tr1, one thereof is connected to the signal line Si while the other is connected to a gate of Tr2.

A gate of transistor Tr3 is connected to the second scanning line Gej. For a source and drain of Tr3, one thereof is connected to the power line Vi while the other is connected to the gate of Tr2.

The capacitance 801 comprises 2 electrodes, one of which is connected to the power line Vi, while the other is connected to the gate of Tr2. When Trn is in a state of non-selection (in another words is in a state of OFF), the capacitance 801 is provided to store the gate voltage of Tr2. Note that the configuration of providing the capacitance 801 is shown in Example 5, the present invention is not solely limited to the configuration described above, that is to say, the capacitance 801 may not be provided.

For a source and a drain of Tr2, one thereof is connected to the power line Vi while the other is connected to a pixel electrode of the light emitting element 802.

The light emitting element 802 comprises an anode, a cathode, an organic light emitting layer provided between the anode and the cathode. When the anode is connected to the source Or the drain of Tr2, the pixel electrode serves as the anode, and the counter electrode serves as the cathode. Conversely, when the cathode is connected to the source or the drain of Tr2, the pixel electrode serves as the cathode, and the counter electrode serves as the anode.

The voltage applied to the power line Vi is corrected by a voltage correction circuit included in the deterioration correction unit. The video signal input to the signal line Si is corrected by a video signal correction circuit included in the deterioration correction unit.

Tr1, Tr2 and Tr3 can be either of a n-channel type TFT or a p-channel type TFT. Further, Tr1, Tr2 and Tr3 can be a double gate configuration, or a multi gate configuration like triple gate configuration instead of a single gate configuration.

Example 5 of the invention may be practiced in combination with any one of examples 1 to 4.

Example 6

In Example 6, the manufacturing method of the light emitting device of the present invention is described. Note that in Example 6, the manufacturing method of a pixel element illustrated in FIG. 2 is described as an example. Further note that the manufacturing method of the present example can be applied to pixel portions having other configurations of the present invention. Further, in Example 6, a sectional view of the pixel element having transistors Tr1 and Tr2 is illustrated. And, in Example 6, an example in which driving circuits (signal line driving circuit and scanning line driving circuit) provided on the perimeter of a pixel portion having TFTs are formed with TFTs of the pixel portion simultaneously on the same substrate is shown.

Figures 10A, 10B, 10C:
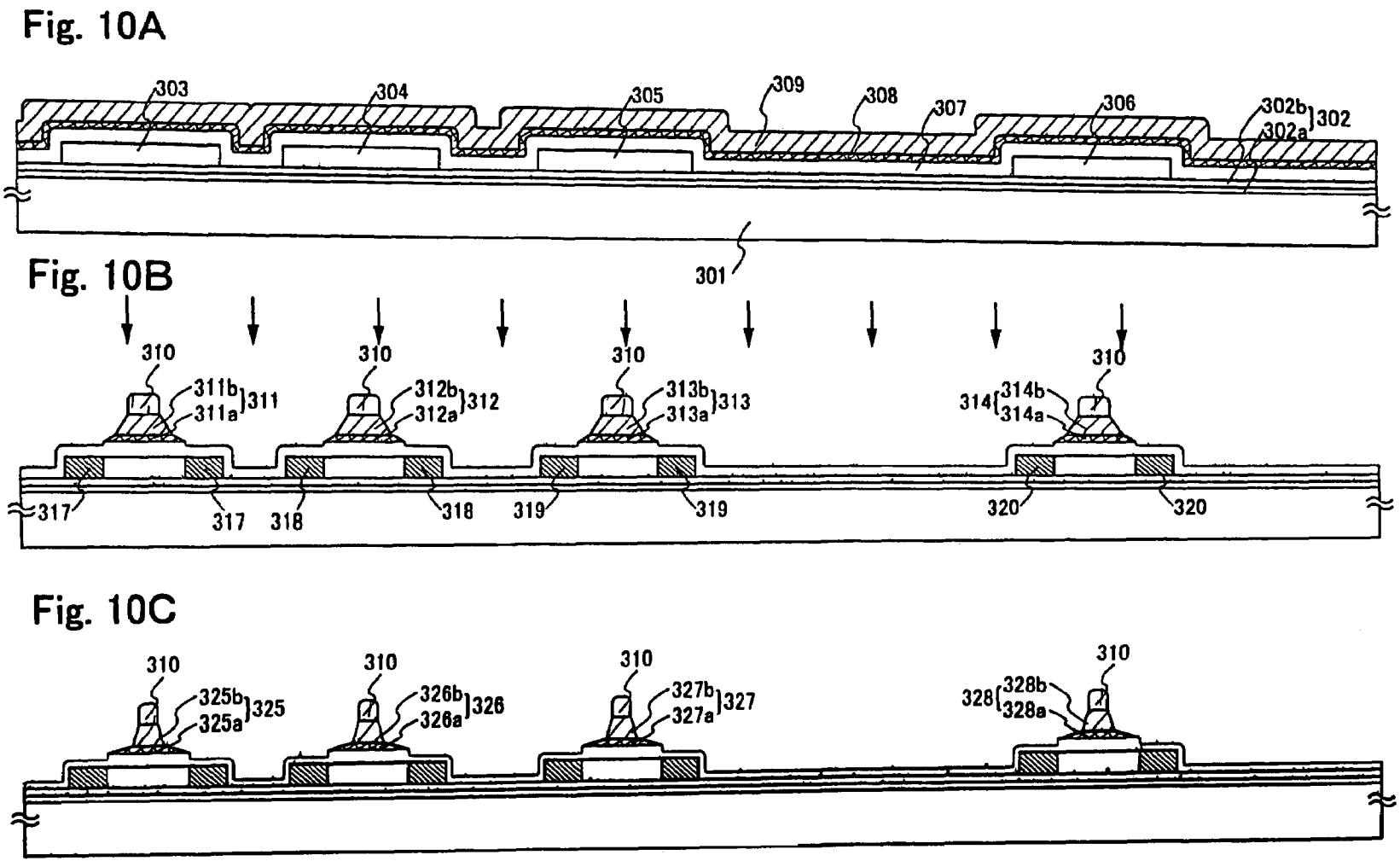
FIGS. 10A to 10C are diagrams illustrating a method for manufacturing the light emitting device according to the invention.

First, as shown in FIG. 10A, a base film 302 consisting of an insulating film such as a silicon oxide film, a silicon nitride film or a silicon oxynitride film is formed on a substrate 301 consisting of glass such as barium borosilicate glass or alumino borosilicate glass represented by: #7059 glass and #1737 glass of Coning Corporation. For example, a silicon oxynitride film 302*a* formed from $SiH_4$, $NH_3$ and $N_2O$ by the plasma CVD method and having a thickness of from 10 to 200 nm (preferably 50 to 100 nm) is formed. Similarly, a hydrogenerated silicon oxynitride film formed from $SiH_4$ and $N_2O$ and having a thickness of from 50 to 200 nm (preferably 100 to 150 nm) is layered thereon. In this example, the base film 302 has a two-layer structure, but may also be formed as a single layer film of one of the above insulating films, or a laminate film having more than two layers of the above insulating films.

Island-like semiconductor layers 303 to 306 are formed from a crystalline semiconductor film obtained by conducting laser crystallization method or a known thermal crystallization method on a semiconductor film having an amorphous structure. Each of these island-like semiconductor layers 303 to 306 has a thickness of from 25 to 80 nm (preferably 30 to 60 nm). No limitation is put on the material of the crystalline semiconductor film, but the crystalline semiconductor film is preferably formed of silicon, or silicon germanium (SiGe) alloy, etc.

When the crystalline semiconductor film is to be manufactured by the laser crystallization method, an excimer laser, a YAG laser and an $YVO_4$ laser of a pulse oscillation type or continuous light emitting type are used. When these lasers are used, it is preferable to use a method in which a laser beam radiated from a laser oscillator is converged into a linear shape by an optical system and then is irradiated to the semiconductor film. A crystallization condition is suitably selected by an operator. When the excimer laser is used, pulse oscillation frequency is set to 300 Hz, and laser energy density is set to from 100 to 400 mJ/cm$^2$ (typically 200 to 300 mJ/cm$^2$). When the YAG laser is used, pulse oscillation frequency is preferably set to from 30 to 300 kHz by using its second harmonic, and laser energy density is preferably set to from 300 to 600 mJ/cm$^2$ (typically 350 to 500 mJ/cm$^2$). The laser beam converged into a linear shape and having a width of from 100 to 1000 μm, e.g. 400 μm is, is irradiated to the entire substrate surface. At this time, overlapping ratio of the linear laser beam is set to from 50 to 90%.

Note that, a gas laser or solid state laser of continuous oscillation type or pulse oscillation type can be used. The gas laser such as an excimer laser, Ar laser, Kr laser and the solid state laser such as YAG laser, $YVO_4$ laser, YLF laser, $YAlO_3$ laser, glass laser, ruby laser, alexandrite laser, Ti: sapphire laser can be used as the laser beam. Also, crystals such as YAG laser, $YVO_4$ laser, YLF laser, $YAlO_3$ laser wherein Cr, Nd, Er, Ho, Ce, Co, Ti or Tm is doped can be used as the solid state laser. A basic wave of the lasers is different depending on the materials of doping, therefore a laser beam having a basic wave of approximately 1 μm is obtained. A harmonic corresponding to the basic wave can be obtained by the using non-linear optical elements.

Further, after an infrared laser light emitted from the solid state laser changes to a green laser light by a non linear optical element, an ultraviolet laser light obtained by another non linear optical element can be used.

When a crystallization of an amorphous semiconductor film is conducted, it is preferable that the second harmonic through the fourth harmonic of basic waves is applied by using the solid state laser which is capable of continuous oscillation in order to obtain a crystal in large grain size. Typically, it is preferable that the second harmonic (with a wavelength of 532 nm) or the third harmonic (with a wavelength of 355 nm) of an Nd: $YVO_4$ laser (basic wave of 1064 nm) is applied. Specifically, laser beams emitted from the continuous oscillation type $YVO_4$ laser with 10 W output is converted into a harmonic by using the non-linear optical elements. Also, a method of emitting a harmonic by applying crystal of $YVO_4$ and the non-linear optical elements into a resonator may be used. Then, more preferably, the laser beams are formed so as to have a rectangular shape or an elliptical shape by an optical system, thereby irradiating a substance to be treated. At this time, the energy density of approximately 0.01 to 100 $MW/cm^2$ (preferably 01. to 10 $MW/cm^2$) is required. The semiconductor film is moved at approximately 10 to 2000 cm/s rate relatively corresponding to the laser beams so as to irradiate the semiconductor film.

Next, a gate insulating film 307 covering the island-like semiconductor layers 303 to 306 is formed. The gate insulating film 307 is formed of an insulating film containing silicon and having a thickness of from 40 to 150 nm by using the plasma CVD method or a sputtering method. In this example, the gate insulating film 307 is formed of a silicon oxynitride film with a thickness of 120 nm. However, the gate insulating film is not limited to such a silicon oxynitride film, but it may be an insulating film containing silicon and having a single layer or a laminated layer structure. For example, when a silicon oxide film is formed by the plasma CVD method, TEOS (Tetraethyl Orthosilicate) and $O_2$ are mixed, the reaction pressure is set to 40 Pa, the substrate temperature is set to from 300 to 400° C., and the high frequency (13.56 MHz) power density is set to from 0.5 to 0.8 $W/cm^2$ for electric discharge. Thus, the silicon oxide film can be formed by discharge. The silicon oxide film formed in this way can then obtain preferable characteristics as the gate insulating film by thermal annealing at from 400 to 500° C.

A first conductive film 308 and a second conductive film 309 for forming a gate electrode are formed on the gate insulating film 307. In this example, the first conductive film 308 having a thickness of from 50 to 100 nm is formed from Ta, and the second conductive film 309 having a thickness of from 100 to 300 nm is formed from W.

The Ta film is formed by a sputtering method, and the target of Ta is sputtered by Ar. In this case, when suitable amounts of Xe and Kr are added to Ar, internal stress of the Ta film is released, and pealing off this film can be prevented. Resistivity of the Ta film of a phase is about 20 μΩcm, and this Ta film can be used for the gate electrode. However, resistivity of the Ta film of β phase is about 180 μΩcm, and is not suitable for the gate electrode. When tantalum nitride having a crystal structure close to that of the a phase of Ta and having a thickness of about 10 to 50 nm is formed in advance as the base for the Ta film to form the Ta film of the a phase, the Ta film of a phase can be easily obtained.

The W film is formed by the sputtering method with W as a target. Further, the W film can be also formed by a thermal CVD method using tungsten hexafluoride ($WF_6$). In any case, it is necessary to reduce resistance to use this film as the gate electrode. It is desirable to set resistivity of the W film to be equal to or smaller than 20 μΩm. When crystal grains of the W film are increased in size, resistivity of the W film can be reduced. However, when there are many impurity elements such as oxygen, etc. within the W film, crystallization is prevented and resistivity is increased. Accordingly, in the case of the sputtering method, a W-target of 99.9999% or 99.99% in purity is used, and the W film is formed by taking a sufficient care of not mixing impurities from a gaseous phase into the W film when the film is to be formed. Thus, a resistivity of from 9 to 20 μΩcm can be realized.

In this example, the first conductive film 308 is formed from Ta, and the second conductive film 309 is formed from W. However, the present invention is not limited to this case. Each of these conductive films may also be formed from an element selected from Ta, W, Ti, Mo, Al and Cu, or an alloy material or a compound material having these elements as principal components. Further, a semiconductor film represented by a polysilicon film doped with an impurity element such as phosphorus may also be used. Examples of combinations other than those shown in this example include: a combination in which the first conductive film 308 is formed from tantalum nitride (TaN), and the second conductive film 309 is formed from W; a combination in which the first conductive film 308 is formed from tantalum nitride (TaN), and the second conductive film 309 is formed from Al; and a combination in which the first conductive film 308 is formed from tantalum nitride (TaN), and the second conductive film 309 is formed from Cu. (FIG. 10).

Next, a mask 310 is formed from a resist, and first etching processing for forming an electrode and wiring is performed. In this example, an ICP (Inductively Coupled Plasma) etching method is used, and $CF_4$ and $Cl_2$ are mixed with a gas for etching. RF (13.56 MHz) power of 500 W is applied to the electrode of coil type at a pressure of 1 Pa so that plasma is generated. RF (13.56 MHz) of 100 W power is also applied to a substrate side (sample stage), and a substantially negative self bias voltage is applied. When $CF_4$ and $Cl_2$ are mixed, the W film and the Ta film are etched to the same extent.

Under the above etching condition, end portions of a first conductive layer and a second conductive layer are formed into a tapered shape by effects of the bias voltage applied to the substrate side by making the shape of the mask formed of the resist into an appropriate shape. The angle of a taper portion is set to from 15° to 45°. It is preferable to increase an etching time by a ratio of about 10 to 20% so as to perform the etching without leaving the residue on the gate insulating film. Since a selection ratio of a silicon oxynitride film to the W film ranges from 2 to 4 (typically 3), an exposed face of the silicon oxynitride film is etched by about 20 to 50 nm by over-etching processing. Thus, conductive layers 311 to 314 of a first shape (first conductive layers 311*a* to 314*a* and second conductive layers 311*b* to 314*b*) formed of the first and second conductive layers are formed by the first etching processing. A region that is not covered with the conductive layers 311 to 316 of the first shape is etched by about 20 to 50 nm in the gate insulating film 307, so that a thinned region is formed. Further, the surface of mask 310 also is etched by the above etching.

Then, an impurity element for giving an n-type conductivity is added by performing first doping processing. A doping method may be either an ion doping method or an ion implantation method. The ion doping method is carried out under the condition that a dose is set to from $1\times10^{13}$ to $5\times10^{14}$ atoms/$cm^2$, and an acceleration voltage is set to from 60 to 100 keV.

An element belonging to group 15, typically, phosphorus (P) or arsenic (As) is used as the impurity element for giving the n-type conductivity. However, phosphorus (P) is used here. In this case, the conductive layers 311 to 314 serve as masks with respect to the impurity element for giving the n-type conductivity, and first impurity regions 317 to 320 are formed in a self-aligning manner. The impurity element for giving the n-type conductivity is added to the first impurity regions 317 to 320 in a concentration range from $1\times10^{20}$ to $1\times10^{21}$ atoms/$cm^3$(FIG. 10B).

Second etching processing is next performed without removing the resist mask 310 as shown in FIG. 10C. A W film is etched selectively by using $CF_4$, $Cl_2$ and $O_2$ as the etching gas. The conductive layers 325 to 328 of a second shape (first conductive layers 325*a* to 328*a* and second conductive layers 325*b* to 328*b*) are formed by the second etching processing. A region of the gate insulating film 307, which is not covered with the conductive layers 325 to 328 of the second shape, is further etched by about 20 to 50 nm so that a thinned region is formed.

An etching reaction in the etching of the W film or the Ta film using the mixed gas of $CF_4$ and $Cl_2$ can be assumed from a radical or ion species generated and the vapor pressure of a reaction product. When the vapor pressures of a fluoride and a chloride of W and Ta are compared, the vapor pressure of $WF_6$ as a fluoride of W is extremely high, and vapor pressures of other $WCl_5$, $TaF_5$ and $TaCl_5$ are approximately equal to each other. Accordingly, both the W film and the Ta film are etched using the mixed gas of $CF_4$ and $Cl_2$. However, when a suitable amount of $O_2$ is added to this mixed gas, $CF_4$ and $O_2$ react and become CO and F so that a large amount of F-radicals or F-ions is generated. As a result, the etching speed of the W film whose fluoride has a high vapor pressure is increased. In contrast to this, the increase in etching speed is relatively small for the Ta film when F is increased. Since Ta is easily oxidized in comparison with W, the surface of the Ta film is oxidized by adding $O_2$. Since no oxide of Ta reacts with fluorine or chlorine, the etching speed of the Ta film is further reduced. Accordingly, it is possible to make a difference in etching speed between the W film and the Ta film so that the etching speed of the W film can be set to be higher than that of the Ta film.

Figures 11A, 11B, 11C:
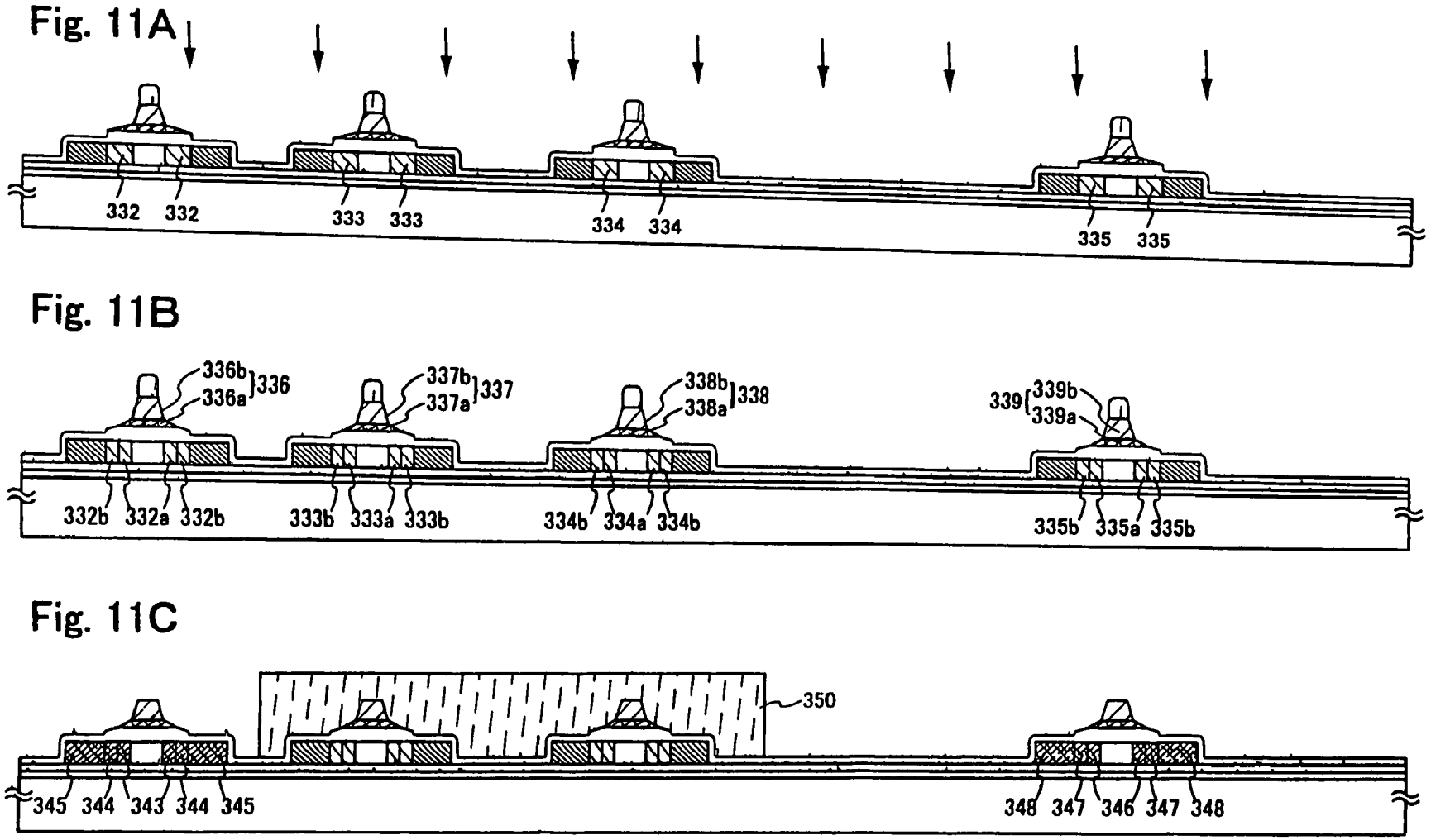
FIGS. 11A to 11C are diagrams illustrating a method for manufacturing the light emitting device according to the invention.

As shown in FIG. 11A, second doping processing is then performed. In this case, an impurity element for giving the n-type conductivity is doped in a smaller dose than in the first doping processing and at a higher acceleration voltage than that in the first doping processing. For example, the acceleration voltage is set to from 70 to 120 keV, and the dose is set to $1\times10^{13}$ atoms/$cm^2$. Thus, a new impurity region is formed inside the first impurity region formed in the island-like semiconductor layer in FIG. 10B. In the doping, the conductive layers 325 to 328 of the second shape are used as masks with respect to the impurity element, and the doping is performed such that the impurity element is also added to regions under the first conductive layers 325*a* to 328*a*. Thus, third impurity regions 332 to 335 are formed. The third impurity regions 332 to 335 contain phosphorus (P) with a gentle concentration gradient that conforms with the thickness gradient in the tapered portions of the first conductive layers 325*a* to 328*a*. In the semiconductor layers that overlap the tapered portions of the first conductive layers 325*a* to 328*a*, the impurity concentration is slightly lower around the center than at the edges of the tapered portions of the first conductive layers 325*a* to 328*a*. However, the difference is very slight and almost the same impurity concentration is kept throughout the semiconductor layers.

Third etching treatment is then carried out as shown in FIG. 11B. $CHF_6$ is used as etching gas, and reactive ion etching (RIE) is employed. Through the third etching treatment, the tapered portions of the first conductive layers 325*a* to 328*a* are partially etched to reduce the regions where the first conductive layers overlap the semiconductor layers. Thus formed are third shape conductive layers 336 to 339 (first conductive layers 336*a* to 339*a* and second conductive layers 336*b* to 339*b*). At this point, regions of the gate insulating film 307 that are not covered with the third shape conductive layers 336 to 339 are further etched and thinned by about 20 to 50 nm.

By means of the third etching treatment in the third impurity regions 332 to 335, the third impurity regions 332*a* to 335*a* that overlap the first conductive layers 336*a* to 339*a* are respectively formed, and second impurity regions 332*b* to 335*b* are respectively formed between the first impurity region and the third impurity region.

As shown in FIG. 11C, fourth impurity regions 343 to 348 having the opposite conductivity type to the first conductivity type are formed in the island-like semiconductor layers 303 and 306 for forming p-channel type TFTs. The third shape conductive layers 336*b* and 339*b* are used as masks against the impurity element and impurity regions are formed in a self-aligning manner. At this point, the island-like semiconductor layers 304 and 305 for forming n-channel type TFTs are entirely covered with a resist mask 350. The impurity regions 343 to 348 have already been doped with phosphorus in different concentrations. The impurity regions 343 to 348 are doped with diborane ($B_2H_6$) through ion doping and its impurity concentrations are set to form $2\times10^{20}$ to $2\times10^{21}$ atoms/$cm^3$ in the respective impurity regions.

Through the steps above, the impurity regions are formed in the respective island-like semiconductor layers. The third shape conductive layers 336 to 339 overlapping the island-like semiconductor layers function as gate electrodes.

After resist mask 350 is removed, a step of activating the impurity elements added to the island-like semiconductor layers is performed to control the conductivity type. This process is performed by a thermal annealing method using a furnace for furnace annealing. Further, a laser annealing method or a rapid thermal annealing method (RTA method) can be applied. In the thermal annealing method, this process is performed at a temperature of from 400 to 700° C., typically from 500 to 600° C. within a nitrogen atmosphere in which oxygen concentration is equal to or smaller than 1 ppm and is preferably equal to or smaller than 0.1 ppm. In this example, heat treatment is performed for four hours at a temperature of 500° C. When a wiring material used in the third shape conductive layers 336 to 339 is weak against heat, it is preferable to perform activation after an interlayer insulating film (having silicon as a principal component) is formed in order to protect wiring, etc.

When the laser annealing method is employed, the laser used in the crystallization can be used. When activation is performed, the moving speed is set as well as the crystallization processing, and the energy density of about 0.01 to 100 MW/$cm^2$ (preferably 0.01 to 10 MW/$cm^2$) is required.

Further, the heat treatment is performed for 1 to 12 hours at a temperature of from 300 to 450° C. within an atmosphere including 3 to 100% of hydrogen so that the island-like semiconductor layer is hydrogenerated. This step is to terminate a dangling bond of the semiconductor layer by hydrogen thermally excited. Plasma hydrogenation (using hydrogen excited by plasma) may also be performed as another measure for hydrogenation.

Figures 12A, 12B:
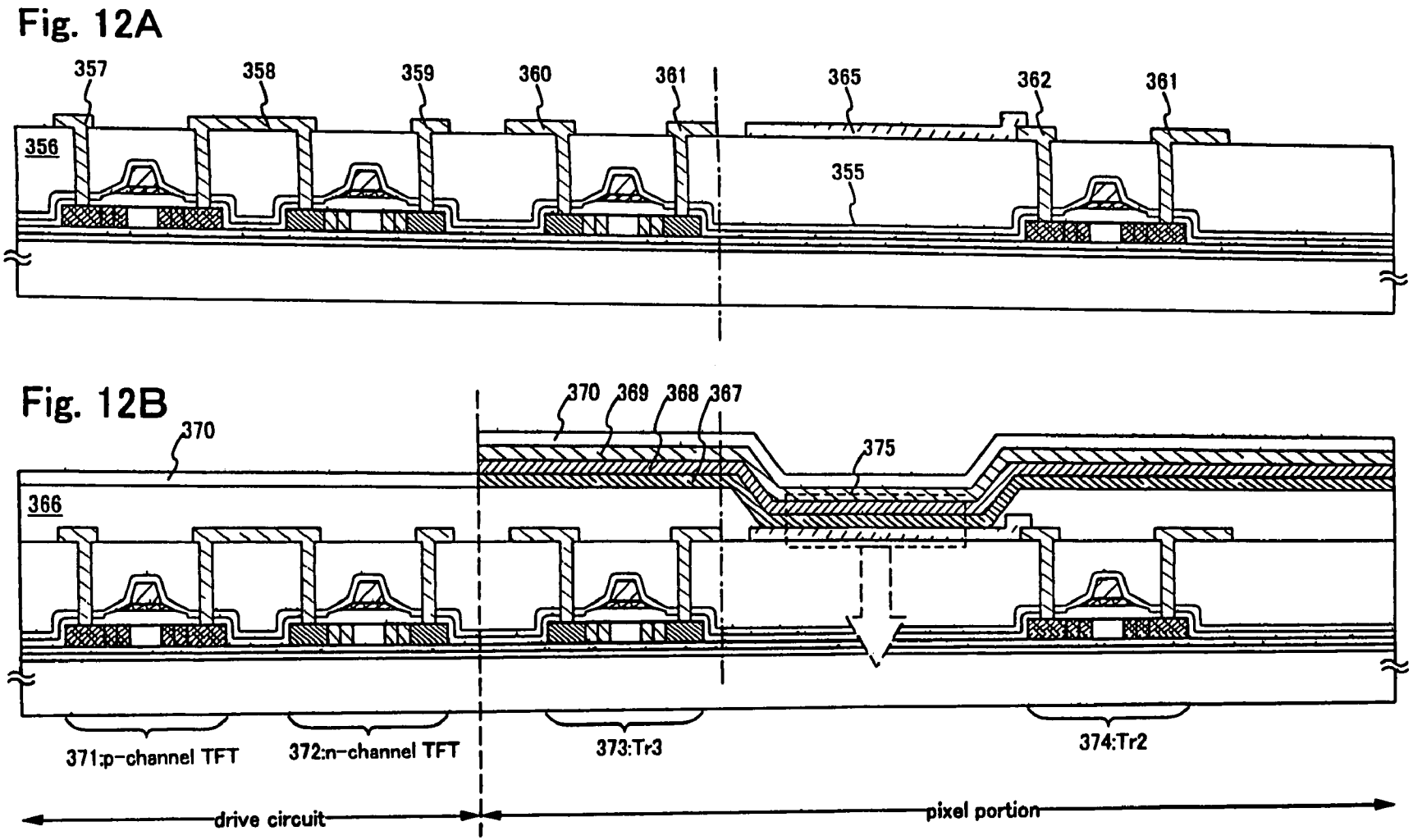
FIGS. 12A and 12B are diagrams illustrating a method for manufacturing the light emitting device according to the invention.

Next, as shown in FIG. 12A, a first interlayer insulating film 355 is formed from a silicon oxynitride film with a thickness of 100 to 200 nm. The second interlayer insulating film 356 is formed of an organic insulating material on the first interlayer insulating film. Thereafter, contact holes are formed through the first interlayer insulating film 355, the second interlayer insulating film 356 and the gate insulating film 307, and connecting wirings 357 to 362 are patterned and formed. Note that reference numeral 362 is a power supply wiring and reference numeral 360 is a signal wiring.

A film having an organic resin as a material is used as the second interlayer insulating film 356. Polyimide, polyamide, acrylic, BCB (benzocyclobutene), etc. can be used as this organic resin. In particular, since the second interlayer insulating film 356 is provided mainly for planarization, acrylic excellent in leveling the film is preferable. In this example, an acrylic film having a thickness that can sufficiently level a level difference caused by the TFT is formed. The film thickness thereof is preferably set to from 1 to 5 μm (is further preferably set to from 2 to 4 μm).

In the formation of the contact holes, contact holes reaching n-type impurity regions 318 and 319 or p-type impurity regions 345 and 348, a contact hole (not illustrated) reaching capacitive wiring (not illustrated) are formed respectively.

Further, a laminate film of a three-layer structure is patterned in a desired shape and is used as connecting wirings 357 to 362. In this three-layer structure, a Ti film with a thickness of 100 nm, an aluminum film containing Ti with a thickness of 300 nm, and a Ti film with a thickness of 150 nm are continuously formed by the sputtering method. Of course, another conductive film may also be used.

The pixel electrode 365 connected to the connecting wiring (connecting wiring) 362 is formed by patterning.

In this example, an ITO film of 110 nm in thickness is formed as a pixel electrode 365, and is patterned. Contact is made by arranging the pixel electrode 365 such that this pixel electrode 365 comes in contact with the connecting electrode 362, and is overlapped with this connecting wiring 362. Further, a transparent conductive film provided by mixing 2 to 20% of zinc oxide (ZnO) with indium oxide may also be used. This pixel electrode 365 becomes an anode of the OLED element (FIG. 12A).

As shown in FIG. 12B, an insulating film (a silicon oxide film in this example) containing silicon and having a thickness of 500 nm is next formed. A third interlayer insulating film 366 functioning as a bank is formed in which an opening is formed in a position corresponding to the pixel electrode 365. When the opening is formed, a side wall of the opening can easily be tapered by using the wet etching method. When the side wall of the opening is not gentle enough, deterioration of an organic light emitting layer caused by a level difference becomes a notable problem.

Next, an organic light emitting layer 367 and a cathode (MgAg electrode) 368 are continuously formed by using the vacuum evaporation method without exposing to the atmosphere. The organic light emitting layer 367 has a thickness of from 80 to 200 nm (typically from 100 to 120 nm), and the cathode 368 has a thickness of from 180 to 300 nm (typically from 200 to 250 nm).

In this process, the organic light emitting layer is sequentially formed with respect to a pixel corresponding to red, a pixel corresponding to green and a pixel corresponding to blue. In this case, since the organic light emitting layer has an insufficient resistance against a solution, the organic light emitting layer must be formed separately for each color instead of using a photolithography technique. Therefore, it is preferable to cover a portion except for desired pixels using a metal mask so that the organic light emitting layer is formed selectively only in a required portion.

Namely, a mask for covering all portions except for the pixel corresponding to red is first set, and the organic light emitting layer for emitting red light are selectively formed by using this mask. Next, a mask for covering all portions except for the pixel corresponding to green is set, and the organic light emitting layer for emitting green light are selectively formed by using this mask. Next, a mask for covering all portions except for the pixel corresponding to blue is similarly set, and the organic light emitting layer for emitting blue light are selectively formed by using this mask. Here, different masks are used, but instead the same single mask may be used repeatedly.

Here, a system for forming three kinds of OLED element corresponding to RGB is used. However, a system in which an OLED element for emitting white light and a color filter are combined, a system in which the OLED element for emitting blue or blue green light is combined with a fluorescent substance (a fluorescent color converting medium: CCM), a system for overlapping the OLED elements respectively corresponding to R, G, and B with the cathodes (opposite electrodes) by utilizing a transparent electrode, etc. may be used.

A known material can be used as the organic light emitting layer 367. An organic material is preferably used as the known material in consideration of a driving voltage. For example, a four-layer structure consisting of a hole injection layer, a hole transportation layer, a light emitting layer and an electron injection layer is preferably used for the organic light emitting layer.

Next, the cathode 368 is formed. This example uses MgAg for the cathode 368 but it is not limited thereto. Other known materials may be used for the cathode 368.

Although not specially illustrated here, it is also possible to take out light up from the upper side by thin-filmizing of the cathode.

The overlapping portion, which is comprised of the pixel electrode 365, the organic light emitting layer 367 and the cathode 368, corresponds to OLED 375.

Next, the protective electrode 369 is formed by an evaporation method. The protective electrode 369 may be formed in succession forming the cathode 368 without exposing the device to the atmosphere. The protective electrode 369 has an effect in order to protect the organic light emitting layer 367 from moisture and oxygen.

The protective electrode 369 also prevents degradation of the cathode 368. A typical material of the protective electrode is a metal film mainly containing aluminum. Other material may of course be used. Since the organic light emitting layer 367 and the cathode 368 are extremely weak against moisture, the organic light emitting layer 367, the cathode 368, and the protective electrode 369 are desirably formed in succession without exposing them to the atmosphere. It is preferable to protect the organic light emitting layer from the outside atmosphere.

Lastly, a passivation film 370 is formed from a silicon nitride film with a thickness of 300 nm. The passivation film 370 protects the organic compound layer 367 from moisture and the like, thereby further enhancing the reliability of the OLED. However, the passivation film 370 may not necessarily be formed.

A light emitting device structured as shown in FIG. 12B is thus completed. Reference symbol 371 denotes p-channel TFT of the driving circuit, 372, n-channel TFT of driving circuit, 373, the transistor Tr4, and 374, the transistor Tr2.

The light emitting device of this example exhibits very high reliability and improved operation characteristics owing to placing optimally structured TFTs in not only the pixel portion but also in the driving circuits. In the crystallization step, the film may be doped with a metal catalyst such as Ni to enhance the crystallinity. By enhancing the crystallinity, the drive frequency of the signal line driving circuit can be set to 10 MHz or higher.

In practice, the device reaching the state, of FIG. 12B is packaged (enclosed) using a protective film that is highly airtight and allows little gas to transmit (such as a laminate film and a UV-curable resin film) or a light-transmissive seal, so as to, further avoid exposure to the outside atmosphere. A space inside the seal may be set to an inert atmosphere or a hygroscopic substance (barium oxide, for example) may be placed there to improve the reliability of the OLED.

After securing the airtightness through packaging or other processing, a connector is attached for connecting an external signal terminal with a terminal led out from the elements or circuits formed on the substrate.

By following the process shown in this example, the number of photo masks needed in manufacturing a light emitting device can be reduced. As a result, the process is cut short to reduce the manufacture cost and improve the yield.

This example can be performed by being freely combined with Example 1 through 5.

Example 7

In this example, an external light emitting quantum efficiency can be remarkably improved by using an organic light emitting material by which phosphorescence from a triplet excitation can be employed for emitting a light. As a result, the power consumption of light emitting element can be reduced, the lifetime of light emitting element can be elongated and the weight of light emitting element can be lightened.

The following is a report where the external light emitting quantum efficiency is improved by using the triplet excitation (T. Tsutsui, C. Adachi, S. Saito, Photochemical processes in Organized Molecular Systems, ed. K. Honda, (Elsevier Sci. Pub., Tokyo, 1991) p. 437).

The molecular formula of an organic light emitting material (coumarin pigment) reported by the above article is represented as follows.

(Chemical formula 1)

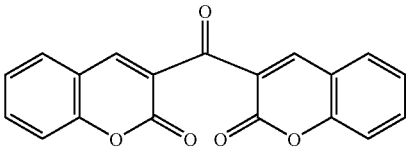

(M. A. Baldo, D. F. O'Brien, Y. You, A. Shoustikov, S. Sibley, M. E. Thompson, S. R. Forrest, Nature 395 (1998) p. 151).

The molecular formula of an organic light emitting material (Pt complex) reported by the above article is represented as follows.

(Chemical formula 2)

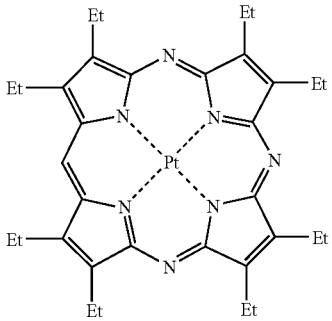

(M. A. Baldo, S. Lamansky, P. E. Burrows, M. E. Thompson, S. R. Forrest, Appl. Phys. Lett., 75 (1999) p-4.)

(T. Tsutsui, M.-J. Yang, M. Yahiro, K. Nakamura, T. Watanabe, T. Tsuji, Y. Fukuda, T. Wakimoto, S. Mayaguchi, Jpn. Appl. Phys., 38 (12B) (1999) L1502)

The molecular formula of an organic light emitting material (Ir complex) reported by the above article is represented as follows.

(Chemical formula 3)

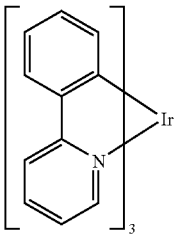

As described above, if phosphorescence from a triplet excitation can be put to practical use, it can realize the external light emitting quantum efficiency three to four times as high as that in the case of using fluorescence from a singlet excitation in principle.

The structure according to this example can be freely implemented in combination of any structures of the Examples 1 to 6.

Example 8

Figure 13:
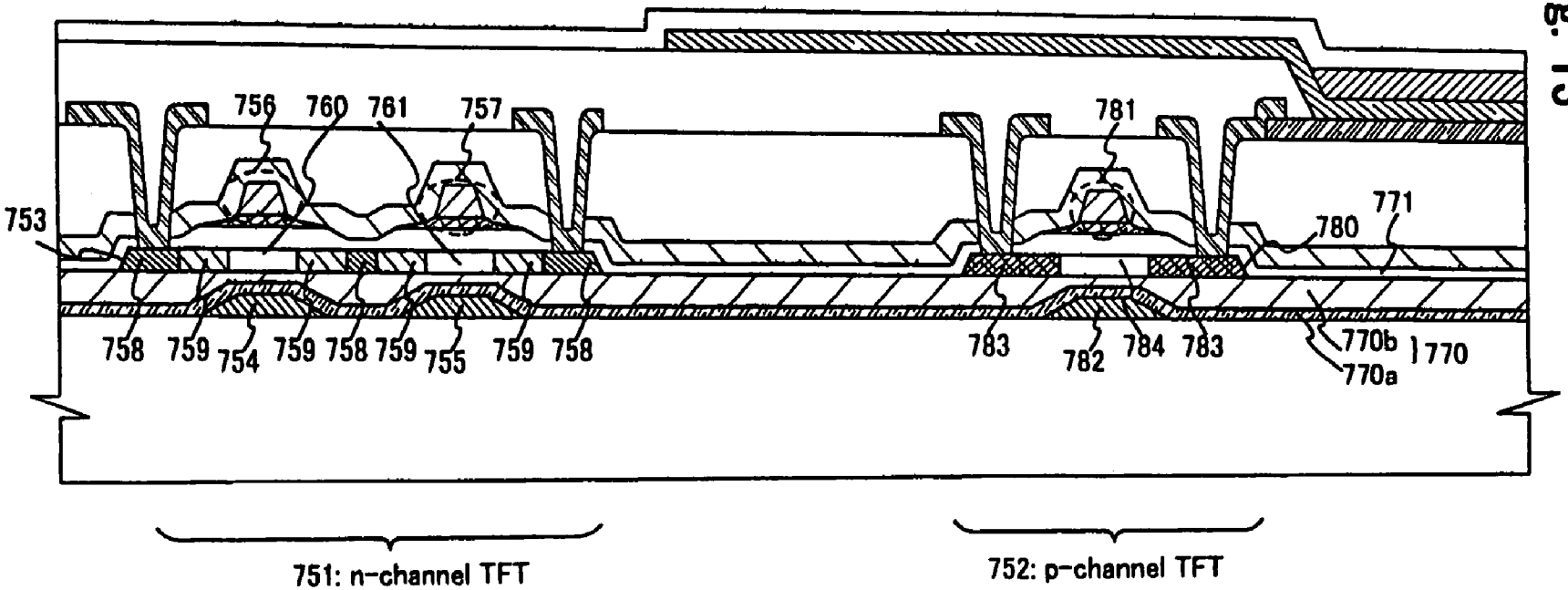
FIG. 13 is a sectional view showing the light emitting device according to the invention.

In this example, configuration of a pixel of a light emitting device of the present invention is described below. FIG. 13 shows a cross-sectional view of a pixel built in a light emitting device according to this example. For simplifying the related illustration, only n-channel type TFTs in pixels and p-channel type TFTs controlling current fed to pixel electrodes are illustrated, other TFTs can be manufactured by referring to the configurations shown in FIG. 13.

Referring to FIG. 13, reference numeral 751 designates an n-channel type TFT, while Reference numeral 752 denotes a p-channel type TFT. The n-channel type TFT 751 comprises a semiconductor film 753, a first insulating film 770, a pair of first electrodes 754 and 755, a second insulating film 771, and a pair of second electrodes 756 and 757. The semiconductor film 753 comprises a one-conductivity-type impurity region 758 having a first impurity concentration, a one-conductivity-type impurity region 759 having a second impurity concentration, and a pair of channel-formation regions 760 and 761.

In this example, the first insulating film 770 consists of a pair of laminated insulating films 770*a* and 770*b*. Alternatively, it is also practicable to provide the first insulating film 770 composed of a single-layer insulating film or an insulating film comprising three or more laminated layers.

The channel-formation regions 760 and 761 oppose a pair of the first electrodes 754 and 755, respectively, through the first insulating film 770 arranged therebetween. The other channel-formation regions 760 and 761 are also superposed on a pair of the second electrodes 756 and 757 by way of sandwiching the second insulating film 771 in-between.

The p-channel type TFT 752 comprises a semiconductor film 780, a first insulating film 770, a first electrode 782, a second insulating film 771, and a second electrode 781. The semiconductor film 780 comprises a one-conductivity-type impurity region 783 having a third impurity concentration, and a channel-formation region 784.

The channel-formation region 784 and the first electrode 782 oppose each other through the first insulating film 770. Further, the channel-formation region 784 and the second electrode 781 also oppose each other through the second insulating film 771 arranged therebetween.

In this example, although not shown in FIG. 13, the first electrodes 754 and 755 are electrically connected to the second electrodes 756 and 757, respectively, each other. It should be noted that the scope of the present invention is not solely limited to the above connecting relationship, but it is also practicable't realize such a configuration in which the first electrodes 754 and 755 are electrically disconnected from the second electrodes 756 and 757 and are applied, with a predetermined voltage. Further, it is also possible to realize such a configuration in which the first electrode 782 is electrically disconnected from the second electrode 781 and is applied with a predetermined voltage.

Compared to the case of utilizing only one electrode, by applying a predetermined voltage to the first electrode, potential variation of the threshold value can be prevented from occurring, and yet, OFF-current can be suppressed. Further, by applying the same voltage to the first and second electrodes, in the same way as in the case of substantially reducing thickness of the semiconductor film, depletion layer quickly spreads, thus making it possible to lower sub-threshold coefficient and further improve the field-effect mobility. Accordingly, compared to the case of utilizing one electrode, it is possible to increase value of an ON current. Further, by employing the above-referred TFTs based on the above-described configurations, it is possible to lower the drive voltage. Further, since it is possible to increase the value of an ON current, it is possible to contract the actual size, in particular, the channel width, of the TFTs. Therefore, it is possible to increase the integration density.

Example 8 can be performed by being freely combined with anyone of Examples 1 to 7.

Example 9

Figure 14:
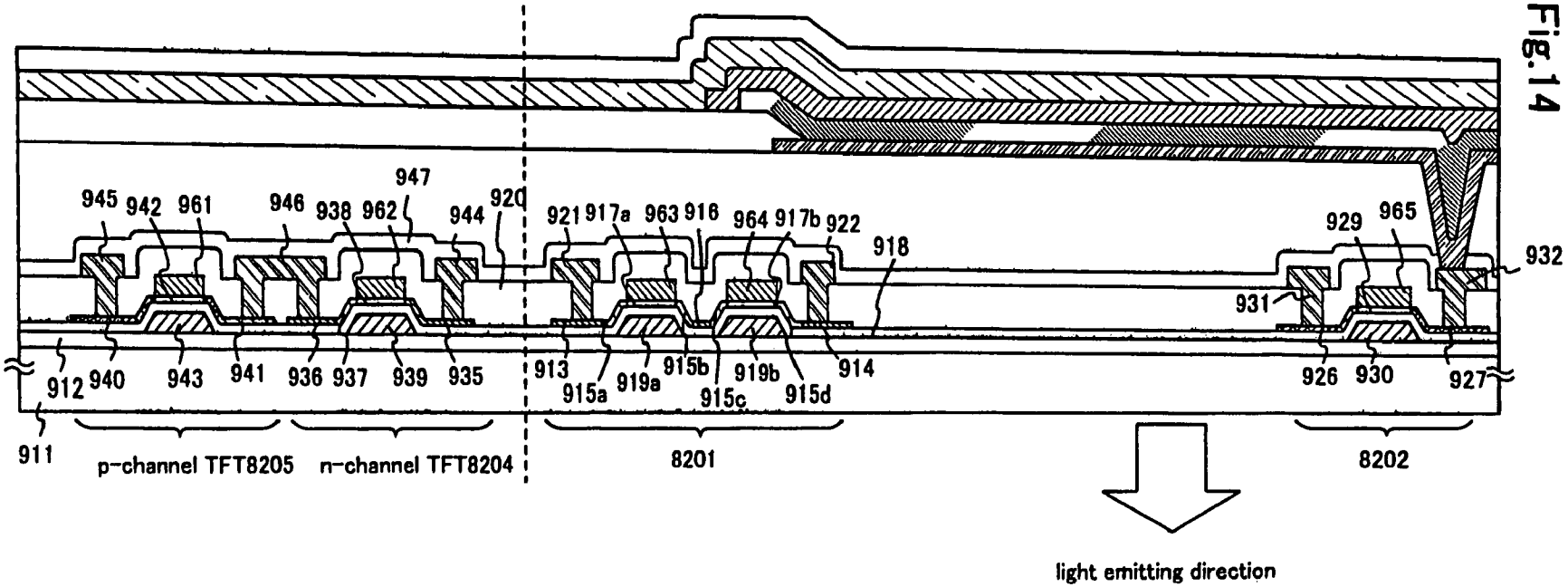
FIG. 14 is a sectional view showing the light emitting device according to the invention.

In this example, configuration of a pixel of a light emitting device being one of the semiconductor devices of the present invention is described below. FIG. 14 shows a cross-sectional view of a pixel built in a light emitting device according to this example. For simplifying the related illustration, while only n-channel type TFTs having pixels and p-channel type TFTs controlling current fed to pixel electrodes are illustrated, other TFTs also can be manufactured by referring to the configurations shown in FIG. 14.

Reference numeral 911 denotes a substrate in FIG. 14, and reference numeral 912 denotes an insulating film which becomes a base (hereafter referred to as a base film). A light transmitting substrate, typically a glass substrate, a quartz substrate, or a glass ceramic substrate can be used as the substrate 911. However, the substrate used must be one able to withstand the highest process temperature during the manufacturing processes.

Reference numeral 8201 denotes an n-channel type TFT, while 8202 denotes a p-channel type TFT. The n-channel type TFT 8201 comprises a source region 913, a drain region 914, LDD regions 915*a*-915*d*, a separating region 916 and active layers having channel formation regions 917*a* and 917*b* therein, a gate insulting film 918, gate electrodes 919*a* and 919*b*, a first interlayer insulting film 920 and a signal wiring 921, a connection wiring 922. Note that the gate insulating film 918 or the first interlayer insulating film 920 may be common among all TFTs on the substrate, or may differ depending upon the circuit or the element.

Further, the n-channel type TFT 8201 shown in FIG. 14 is electrically connected to the gate electrodes 917*a* and 917*b*, becoming namely a double gate structure. Not only the double gate structure, but also a multi gate structure (a structure containing an active layer having two or more channel forming regions connected in series) such as a triple gate structure, may of course also be used.

The multi-gate structure is extremely effective in reducing the off current, and provided that the off current of the Tr5 is sufficiently lowered, a minimum necessary capacitance of a storage capacitor connected to the gate electrode of the p-channel type TFT 8202 can be reduced. Namely, the surface area of the storage capacitor can be made smaller, and therefore using the multi-gate structure is also effective in expanding the effective light emitting surface area of the organic light emitting elements.

In addition, the LDD regions 915*a* to 915*d* are formed so as not to overlap the gate electrodes 919*a* and 919*b* through the gate insulating film 918 in the n-channel type TFT 8201. This type of structure is extremely effective in reducing the off current. Furthermore, the length (width) of the LDD regions 915*a* to 915*d* may be set from 0.5 to 3.5 μm, typically between 2.0 and 2.5 μm. Further, when using a multi-gate structure having two or more gate electrodes, the separating region 916 (a region to which the same impurity element, at the same concentration, as that added to the source region or the drain region, is added) is effective in reducing the off current.

Next, the p-channel type 8202 is formed having an active layer containing a source region 926, a drain region 927, and a channel region 929; the gate insulating film 918; a gate electrode 930, the first interlayer insulating film 920; a connecting wiring 931; and a connecting wiring 932. The p-channel type 8202 is a p-channel TFT in Example 9.

Incidentally, while the gate electrode 930 is a single gate structure, the gate electrode 930 may be a multi gate structure.

The structures of the TFTs formed within the pixel are explained above. On the other hand, a driver circuit is also formed simultaneously at this point. A CMOS circuit, which becomes a basic unit for forming the driver circuit, is shown in FIG. 14.

A TFT having a structure in which hot carrier injection is reduced without an excessive drop in the operating speed is used as an n-channel TFT 8204 of the CMOS circuit in FIG. 14. Note that the term driver circuit indicates a source signal line driver circuit and a gate signal line driver circuit here. It is also possible to form other logic circuit (such as a level shifter, an A/D converter, and a signal division circuit).

An active layer of the n-channel TFT 8204 of the CMOS circuit contains a source region 935, a drain region 936, an LDD region 937, and a channel region 938. The LDD region 937 overlaps with a gate electrode 939 through the gate insulating film 918.

Formation of the LDD region 937 on only the drain region 936 side is so as not to lower the operating speed. Further, it is not necessary to be so concerned about the off current with the n-channel TFT 8204, and it is preferable to place more importance on the operating speed. Thus, it is desirable that the LDD region 937 is made to completely overlap the gate electrode to decrease a resistance component to a minimum. It is therefore preferable to eliminate so-called offset.

Furthermore, there is almost no need to be concerned with degradation of a p-channel TFT 8205 of the CMOS circuit, due to hot carrier injection, and therefore a LDD region is not necessarily formed in particular. Its active layer therefore contains a source region 940, a drain region 941, and a channel forming region 942, and a gate insulating film 918 and a gate electrode 943 are formed on the active layer. It is also possible, of course, to take measures against hot carrier injection by forming an LDD region similar to that of the n-channel TFT 8204.

The reference numerals 961 to 965 are masks to form the channel region 942, 938, 917*a*, 917*b*, and 929.

Further, the n-channel TFT 8204 and the p-channel TFT 8205 have connecting wirings 944 and 945, respectively, on their source regions, through the first interlayer insulating film 920. In addition, the drain regions of the n-channel TFT 8204 and the p-channel TFT 8205 are mutually connected electrically by a connecting wiring 946.

Note that the structure of this example can be performed by freely combining with Examples 1 to 7.

Example 10

The following description on this example refers to the configuration of a pixel utilizing a cathode as a pixel electrode.

Figure 15:
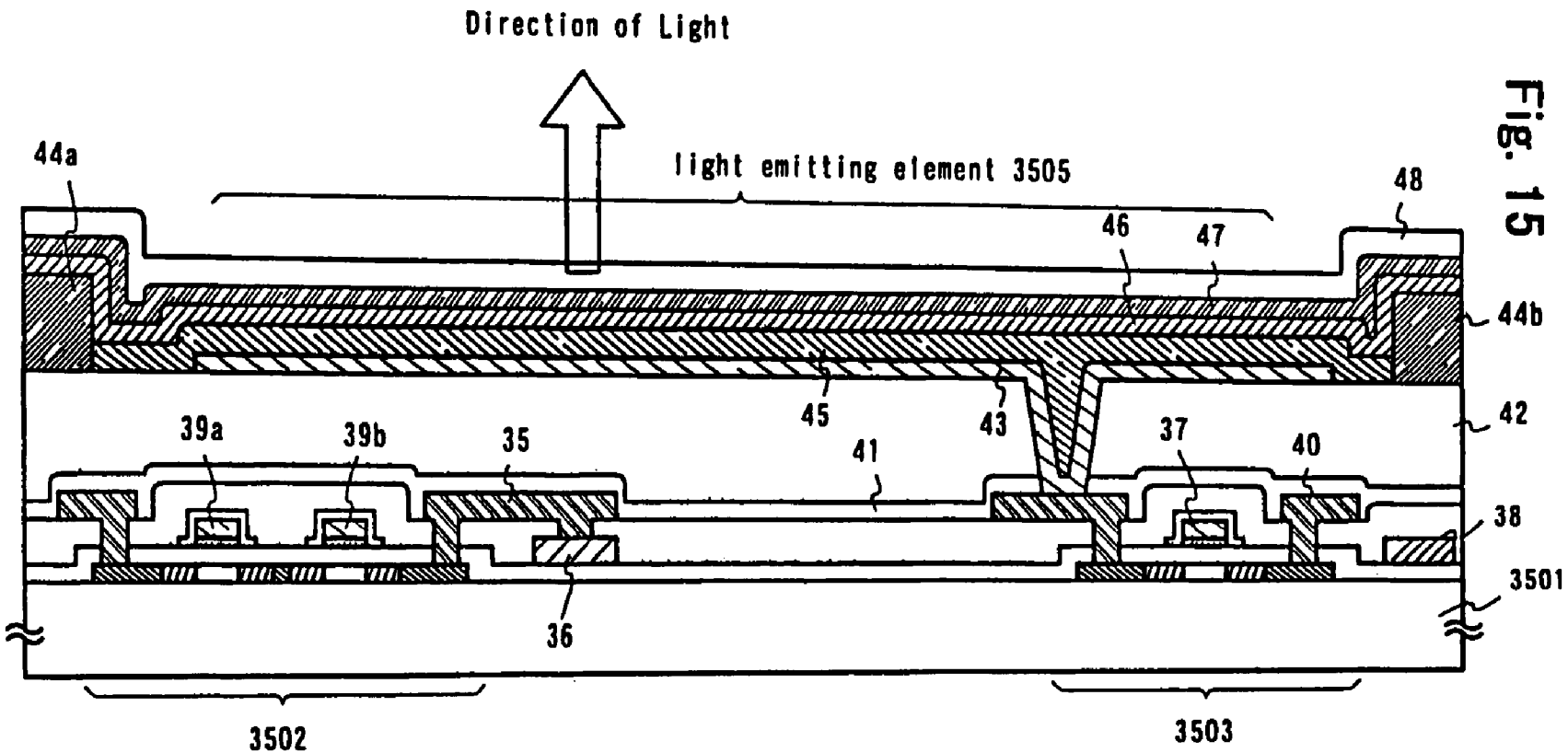
FIG. 15 is a sectional view showing the light emitting device according to the invention.

FIG. 15 exemplifies a cross-sectional view of a pixel according to this example. In FIG. 15, an n-channel type TFT 3502 manufactured on a substrate 3501 is manufactured by applying a conventional method. In this example, an n-channel type TFT 3502 based on the double-gate construction is used. However, it is also practicable to employ a single-gate construction, or a triple-gate construction, or a multiple-gate construction incorporating more than three of gate electrodes. To simplify the illustration, only n-channel type TFTs having pixels and p-channel type TFTs controlling current fed to pixel electrodes are illustrated, other TFTs can also be manufactured by referring to the structures shown in FIG. 15.

A p-channel type TFT 3503 can be manufactured by applying a known method. A wiring designated by reference numeral 38 corresponds to a scanning line for electrically linking a gate electrode 39*a* of the above n-channel type TFT 3502 with the other gate electrode 39*b* thereof.

In this example shown in FIG. 15, the above p-channel type TFT 3503 is illustrated as having a single-gate construction. However, the p-channel type TFT 3503 may have a multiple-gate construction in which a plurality of TFTs are connected in series with each other. Further, such a construction may also be introduced, which substantially splits a channel-formation region into plural parts connecting a plurality of TFTs in parallel with each other, thereby enabling them to radiate heat with higher efficiency. This construction is quite effective to cope with thermal degradation of the TFTs.

A first inter-layer insulating film 41 is formed on the n-channel type TFT 3502 and p-channel type 3503. Further, a second inter-layer insulating film 42 made of resinous insulating film is formed on the first inter-layer insulating film 41. It is extremely important to fully level off steps produced by provision of TFTs by utilizing the second inter-layer insulating film 42. This is because, since organic light emitting layers to be formed later on are extremely thin, since presence of such steps may cause faulty in light emission to occur. Taking this into consideration, before forming the pixel electrode, it is desired that the above-referred steps be leveled off as much as possible so that the organic light emitting layers can be formed on a fully leveled surface.

Reference numeral 43 in FIG. 15 designates a pixel electrode, i.e., a cathode, electrode provided for the light emitting element, composed of a highly reflective electrically conductive film. The pixel electrode 43 is electrically connected to the drain region of the p-channel type TFT 3503. For the pixel electrode 43, it is desired to use an electrically conductive film having a low resistance value such as an aluminum alloy film, a copper alloy film, or a silver alloy film, or a laminate of these alloy films. It is of course practicable to utilize such a construction that employs a laminate comprising the above-referred alloy films combined with other kinds of metallic films bearing electrical conductivity.

FIG. 15 exemplifies a light emitting layer 45 formed inside of a groove (this corresponds to a pixel) produced between a pair of banks 44*a* and 44*b* which are made from resinous insulating films. Although not shown in FIG. 15, it is also practicable to separately form a plurality of light emitting layers respectively corresponding to three colors of red, green, and blue. Organic light emitting material such as π-conjugate polymer material is utilized to compose the light emitting layers. Typically, available polymer materials include the following: polyparaphenylene vinylene (PPV), polyvinyl carbazol (PVK), and polyfluorene, for example.

There are a wide variety of organic light emitting materials comprising the above-referred PPV. For example, such materials cited in the following publications may be used: H. Shenk, H. Becker, O. Gelsen, E. Kluge, W. Spreitzer "Polymers for Light Emitting Diodes", Euro Display, Proceedings, 1999, pp. 33-37, and such material, set forth in the JP-10-92576 A.

As a specific example of the above-referred light emitting layers, there may be used cyano-polyphenylene-vinylene for composing a layer for emitting red light; polyphenylene-vinylene for composing a layer for emitting green light; and polyphnylene-vinylene or polyalkylphenylene for composing a layer for emitting blue light. It is suggested that the thickness of an individual light emitting layer shall be defined in a range of from 30 nm to 150 nm, preferably in a range of from 40 nm to 100 nm.

The above description, however, has solely referred to a typical example of organic light emitting materials available for composing light emitting layers, and thus, applicable organic light emitting materials are not necessarily limited to those which are cited above. Thus, organic light emitting layers (layers for enabling light emission as well as movement of carriers therefor) freely combining light emitting layers, charge-transfer layers, and charge-injection layers with each other.

For example, this example has exemplified such a case in which polymer materials are utilized for composing light emitting layers. However, it is also possible to utilize organic light emitting materials comprising low-molecular weight compound, for example. To compose a charge-transfer layer and a charge-injection layer, it is also possible to utilize inorganic materials such as silicon carbide for example. Conventionally known materials may be used as the organic materials and the inorganic materials.

In this example, organic light emitting layers having a laminate structure are formed, in which a hole injection layer 46 made from polythiophene (PEDOT) or polyaniline (PAni) is formed on the light emitting layer 45. An anode electrode 47 composed of a transparent electrically conductive film is formed on the hole injection layer 46. In the pixel shown in FIG. 15, light is generated from the light emitting layers 45 in the upward direction from the TFT. Therefore, the anode electrode 47 must be light-permeable. To form a transparent electrically conductive film, a compound comprising indium oxide and tin dioxide or a compound comprising indium oxide and zinc oxide may be utilized. However, since the transparent electrically conductive film is formed after completing formation of the light emitting layer 45 and the hole injection layer 46 both having poor heat-resisting property, it is desired that the anode 47 be formed at a temperature as low as possible.

Upon completion of the formation of the anode electrode 47, the light emitting element 3505 is completed. Here, the light emitting element 3505 is provided with the pixel electrode (cathode electrode) 43, the light emitting layers 45, the hole injection layer 46, and the anode electrode 47. Since the area of the pixel electrode 43 substantially coincides with the total area of the pixel, the entire pixel functions itself as a light emitting element. Accordingly, an extremely high light-emitting efficiency is attained in practical use, thereby making it possible to display an image with high luminance.

This example further provides a second passivation film 48 on the anode electrode 47. It is desired that silicon nitride or silicon oxynitride be utilized for composing the second passivation film 48. The second passivation film 48 shields the light emitting element 3505 from the external in order to prevent unwanted degradation thereof caused by oxidation of the organic light emitting material and also prevent gas component from leaving the organic light emitting material. By virtue of the above arrangement, reliability of the light emitting device is enhanced furthermore.

Figure 18A:
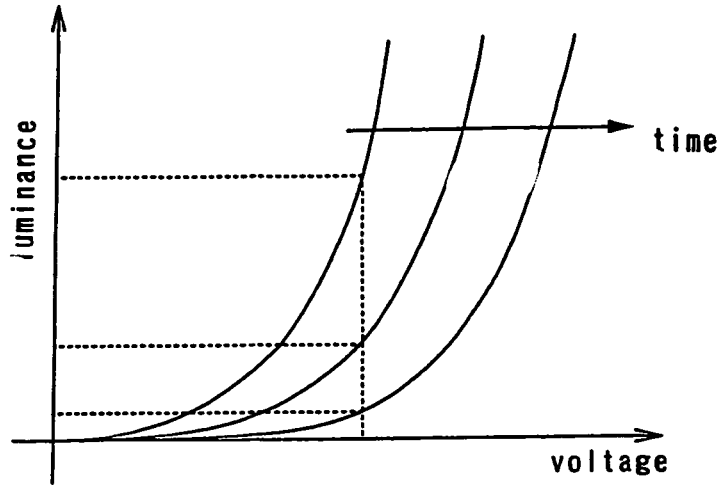
FIGS. 18A to 18C are graphs representing the variations in luminance of the light emitting element due to deterioration.
Figure 18B:
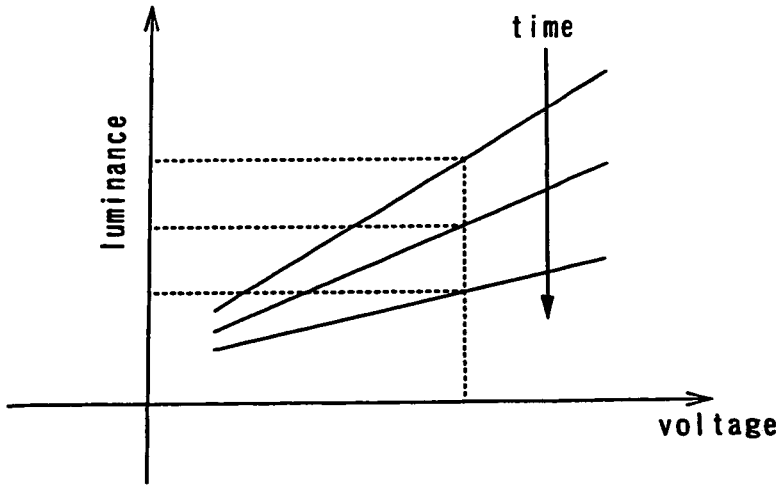
Figure 18C:
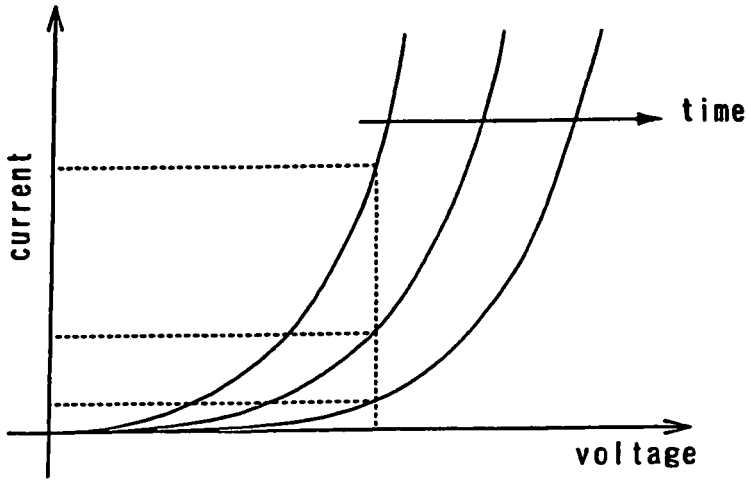

As described above, the light emitting device of the present invention shown in FIG. 15 includes pixel portions each having the configuration as exemplified therein. In particular, the light emitting device utilizes the TFT 3502 with a sufficiently a low OFF current value and the TFT 3503 capable of fully withstanding injection of heated carriers. Because of these advantageous features, the light emitting device shown in FIG. 18 has enhanced reliability and can display clear image.

Incidentally, the structure of Example 10 can be performed by freely combining with the structure of Examples 1 to 7.

Example 11

Organic light emitting materials used in OLEDs are roughly divided into low molecular weight materials and high molecular weight materials. A light emitting device of the present invention can employ a low molecular weight organic light emitting material and a high molecular weight organic light emitting material both.

A low molecular weight organic light emitting material is formed into a film by evaporation. This makes it easy to form a laminate structure, and the efficiency is increased by layering films of different functions such as a hole transporting layer and an electron transporting layer.

Examples of low molecular weight organic light emitting material include an aluminum complex having quinolinol as a ligand ($Alq_3$) and a triphenylamine derivative (TPD).

On the other hand, a high molecular weight organic light emitting material is physically stronger than a low molecular weight material and enhances the durability of the element. Furthermore, a high molecular weight material can be formed into a film by application and therefore manufacture of the element is relatively easy.

The structure of a light emitting element using a high molecular weight organic light emitting material is basically the same as the structure of a light emitting element using a low molecular weight organic light emitting material, and has a cathode, an organic light emitting layer, and an anode in order. When an organic light emitting layer is formed from a high molecular weight organic light emitting material, a two-layer structure is popular among the known ones. This is because it is difficult to form a laminate structure using a high molecular weight material unlike the case of using a low molecular weight organic light emitting material. Specifically, an element using a high molecular weight organic light emitting material has a cathode (an Al alloy), a light emitting layer, a hole transporting layer, and an anode (ITO). Ca may be employed as the cathode material in a light emitting element using a high molecular weight organic light emitting material.

The color of light emitted from an element is determined by the material of its light emitting layer. Therefore, a light emitting element that emits light of desired color can be formed by choosing an appropriate material. The high molecular weight organic light emitting material that can be used to form a light emitting layer is a polyparaphenylene vinylene-based material, a polyparaphenylene-based material, a polythiophen-based material, or a polyfluorene-based material.

The polyparaphenylene vinylene-based material is a derivative of poly(paraphenylene vinylene) (denoted by PPV), for example, poly(2, 5-dialkoxy-1, 4-phenylene vinylene) (denoted by RO-PPV), poly(2-(2'-ethyl-hexoxy)-5-metoxy-1, 4-phenylene vinylene) (denoted by MEH-PPV), and poly(2-(dialkoxyphenyl)-1, 4-phenylene vinylene) (denoted by ROPh-PPV).

The polyparaphenylene-based material is a derivative of polyparaphenylene (denoted by PPP), for example, poly(2, 5-dialkoxy-1, 4-phenylene) (denoted by RO-PPP) and poly (2, 5-dihexoxy-1, 4-phenylene).

The polythiophene-based material is a derivative of polythiophene (denoted by PT), for example, poly(3-alkylthiophene) (denoted by PAT), poly(3-hexylthiophene) (denoted by PHT), poly(3-cyclohexylthiophene) (denoted by PCHT), poly(3-cyclohexyl-4-methylthiophene) (denoted by PCHMT), poly(3, 4-dicyclohexylthiophene) (denoted by PDCHT), poly[3-(4-octylphenyl)-thiophene] (denoted by POPT), and poly[3-(4-octylphenyl)-2, 2 bithiophene] (denoted by PTOPT).

The polyfluorene-based material is a derivative of polyfluorene (denoted by PF), for example, poly(9, 9-dialkylfluorene) (denoted by PDAF) and poly(9, 9-dioctylfluorene) (denoted by PDOF).

If a layer that is formed of a high molecular weight organic light emitting material capable of transporting holes is sandwiched between an anode and a high molecular weight organic light emitting material layer that emits light, injection of holes from the anode is improved. This hole transporting material is generally dissolved into water together with an acceptor material, and the solution is applied by spin coating or the like. Since the hole transporting material is insoluble in an organic solvent, the film thereof can form a laminate with the above-mentioned organic light emitting material layer that emits light.

The high molecular weight organic light emitting material capable of transporting holes is obtained by mixing PEDOT with camphor sulfonic acid (denoted by CSA) that serves as the acceptor material. A mixture of polyaniline (denoted by PANI) and polystyrene sulfonic acid (denoted by PSS) that serves as the acceptor material may also be used.

Besides the low molecular weight materials and high molecular weight materials described above, the other organic light emitting materials which do not have sublimability, and have molecularity equal to or less than 20 or have a molecular chain length equal to or less than 10 μm, namely intermediate molecular weight materials also may be used.

The structure of Example 11 may be realized by freely combining with any of the structures of Example 1 through 10.

Example 12

The light emitting device using the light emitting element is of the self-emission type, and thus exhibits more excellent recognizability of the displayed image in a light place as compared to the liquid crystal display device. Furthermore, the light emitting device has a wider viewing angle. Accordingly, the light emitting device can be applied to a display portion in various electronic apparatuses.

Such electronic apparatuses using a light emitting device of the present invention include a video camera, a digital camera, a goggles-type display (head mount display), a navigation system, a sound reproduction device (a car audio equipment and an audio set), a lap-top computer, a game machine, a portable information terminal (a mobile computer, a mobile phone, a portable game machine, an electronic book, or the like), an image reproduction device including a recording medium (more specifically, an device which can reproduce a recording medium such as a digital versatile disc (DVD) and so forth, and includes a display for displaying the reproduced image), or the like. In particular, in the case of the portable information terminal, use of the light emitting device is preferable, since the portable information terminal that is likely to be viewed from a tilted direction is often required to have a wide viewing angle. FIG. 16 respectively shows various specific examples of such electronic apparatuses.

Figure 16A:
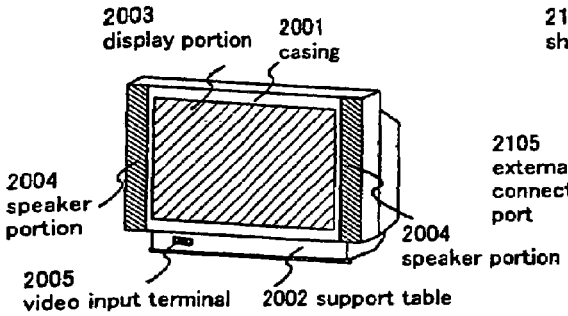
FIGS. 16A to 16H are diagrams illustrating electronic apparatuses employing the light emitting device according to the invention.

FIG. 16A illustrates an light emitting element display device which includes a casing 2001, a support table 2002, a display portion 2003, a speaker portion 2004, a video input terminal 2005 or the like. The present invention is applicable to the display portion 2003. The light emitting device is of the self-emission-type and therefore requires no backlight. Thus, the display portion thereof can have a thickness thinner than that of the liquid crystal display device. The organic light emitting display device is including the entire display device, for displaying information, such as a personal computer, a receiver of TV broadcasting and an advertising display.

Figure 16B:
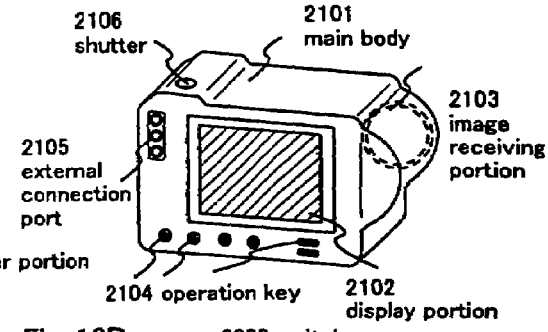

FIG. 16B illustrated a digital still camera which includes a main body 2101, a display portion 2102, an image receiving portion 2103, an operation key 2104, an external connection port 2105, a shutter 2106, or the like. The light emitting device in accordance with the present invention is used as the display portion 2102, thereby the digital still camera of the present invention completing.

Figure 16C:
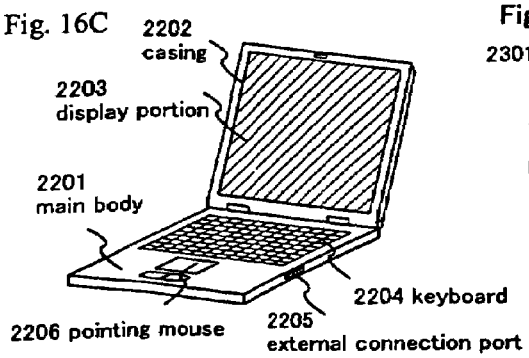

FIG. 16C illustrates a lap-top computer which includes a main body 2201, a casing 2202, a display portion 2203, a keyboard 2204, an external connection port 2205, a pointing mouse 2206, or the like. The light emitting device in accordance with the present invention is used as the display portion 2203, thereby the lap-top computer of the present invention completing.

Figure 16D:
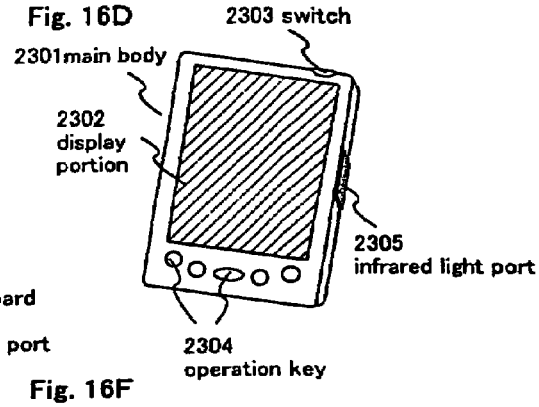

FIG. 16D illustrated a mobile computer which includes a main body 2301, a display portion 2302, a switch 2303, an operation key 2304, an infrared light port 2305, or the like. The light emitting device in accordance with the present invention is used as the display portion 2302, thereby the mobile computer of the present invention completing.

Figure 16E:
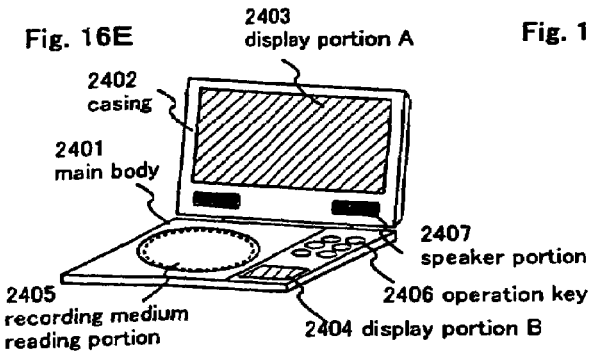

FIG. 16E illustrates a portable image reproduction device including a recording medium (more specifically, a DVD reproduction device), which includes a main body 2401, a casing 2402, a display portion A 2403, another display portion B 2404, a recording medium (DVD or the like) reading portion 2405, an operation key 2406, a speaker portion 2407 or the like. The display portion A 2403 is used mainly for displaying image information, while the display portion B 2404 is used mainly for displaying character information. The image reproduction device including a recording medium further includes a game machine or the like. The light emitting device in accordance with the present invention is used as these display portions A 2403 and B 2404, thereby the image reproduction device of the present invention completing.

Figure 16F:
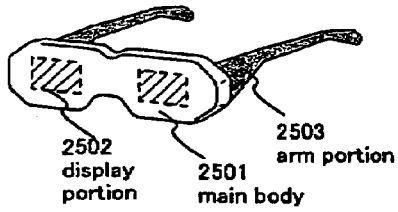

FIG. 16F illustrates a goggle type display (head mounted display) which includes a main body 2501, a display portion 2502, arm portion 2503 or the like. The light emitting device in accordance with the present invention is used as the display portion 2502, thereby the goggle type display of the present invention completing.

Figure 16G:
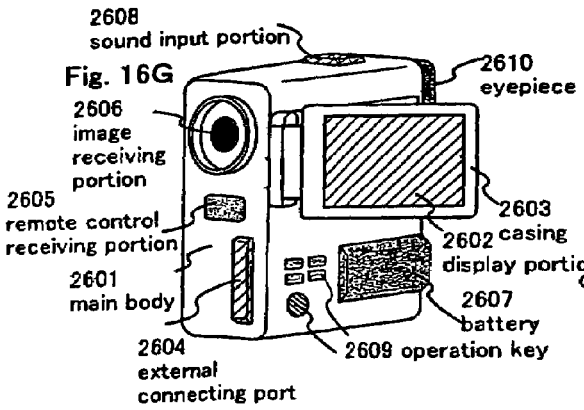

FIG. 16G illustrates a video camera which includes a main body 2601, a display portion 2602, a casing 2603, an external connecting port 2604, a remote control receiving portion 2605, an image receiving portion 2606, a battery 2607, a sound input portion 2608, an operation key 2609, an eyepiece 2610, or the like. The light emitting device in accordance with the present invention is used as the display portion 2602, thereby the video camera of the present invention completing.

Figure 16H:
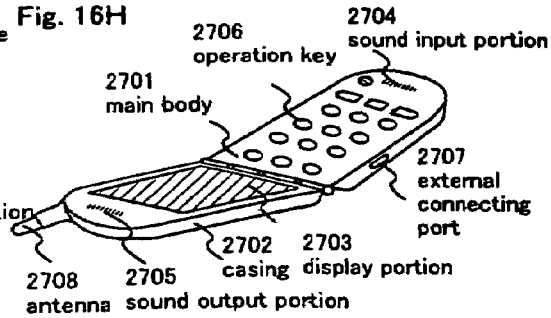

FIG. 16H illustrates a mobile phone which includes a main body 2701, a casing 2702, a display portion 2703, a sound input portion 2704, a sound output portion 2705, an operation key 2706, an external connecting port 2707, an antenna 2708, or the like. Note that the display portion 2703 can reduce power consumption of the mobile telephone by displaying white-colored characters on a black-colored background. The light emitting device in accordance with the present invention is used as the display portion 2703, thereby the mobile phone of the present invention completing.

When the brighter luminance of light emitted from the organic light emitting material becomes available in the future, the light emitting device in accordance with the present invention will be applicable to a front-type or rear-type projector in which light including output image information is enlarged by means of lenses or the like to be projected.

The aforementioned electronic apparatuses are more likely to be used for display information distributed through a telecommunication path such as Internet, a CATV (cable television system), and in particular likely to display moving picture information. The light emitting device is suitable for displaying moving pictures since the organic light emitting material can exhibit high response speed.

A portion of the light emitting device that is emitting light consumes power, so it is desirable to display information in such a manner that the light emitting portion therein becomes as small as possible. Accordingly, when the light emitting device is applied to a display portion which mainly displays character information, e.g., a display portion of a portable information terminal, and more particular, a portable telephone or a sound reproduction device, it is desirable to drive the light emitting device so that the character information is formed by a light emitting portion while a non-emission portion corresponds to the background.

As set forth above, the present invention can be applied variously to a wide range of electronic apparatuses in all fields. The electronic apparatuses in this example can be obtained by utilizing a light emitting device having the structure in which the structures in Example 1 through 11 are freely combined.

Example 13

In this example, in a light emitting device having pixels of 176×RGB×220, taking as an example a deterioration correcting device for correcting a video signal in which the respective colors are displayed in a gray scale of 6 bits, a description will be made of a specific structure thereof.

Figure 19:
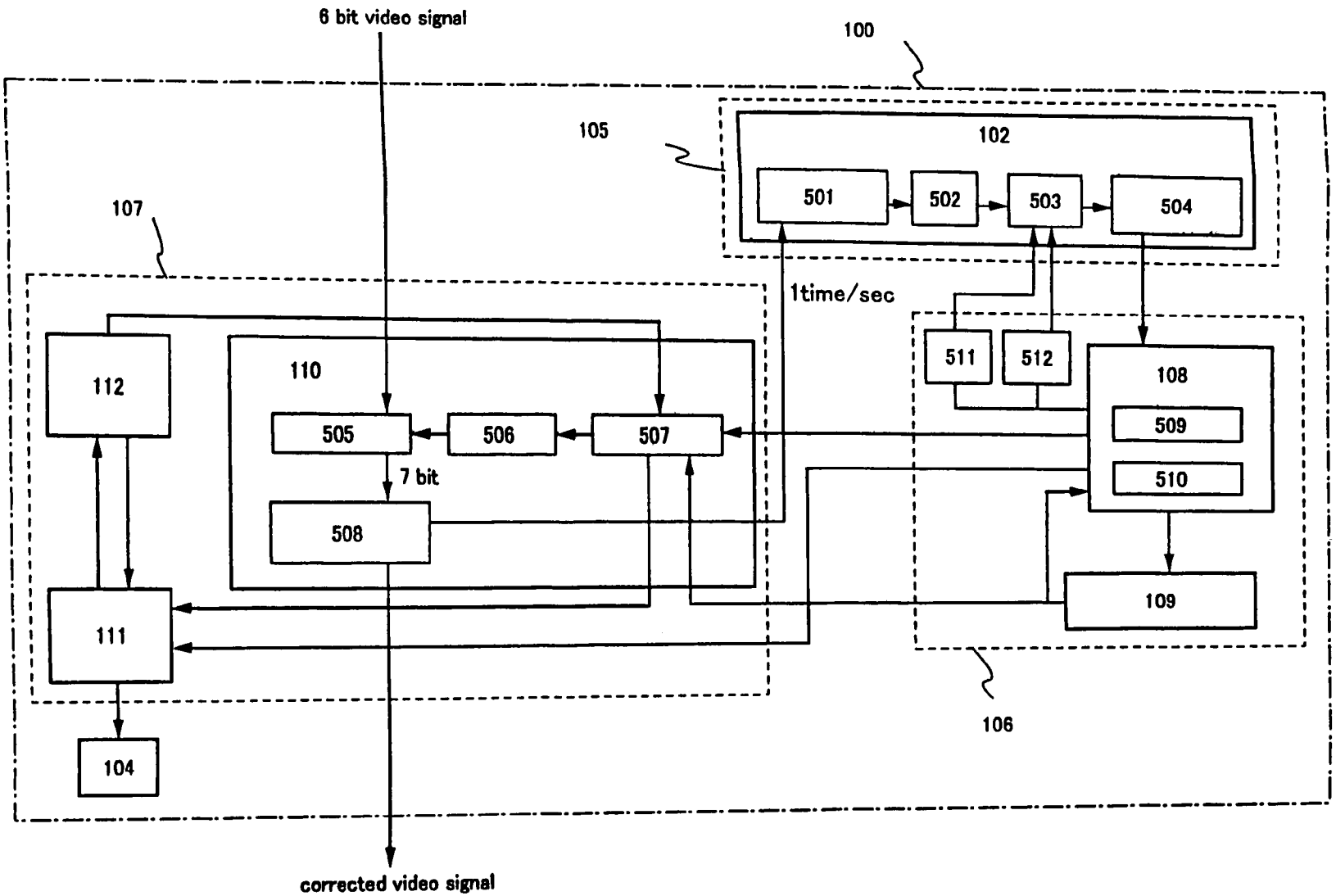
FIG. 19 is a block diagram showing a deterioration correction unit.

FIG. 19 is a block diagram showing the deterioration correcting device of this example. In the figure, parts already shown in FIG. 1 are denoted by the same reference numerals as FIG. 1. As shown in FIG. 19, a counter 102 includes a sampling circuit 501, a register 502, an adder 503, and a line memory 504 (176×32-bit). Further, a video signal correcting circuit 110 includes an integration circuit 505, a register 506, an arithmetic circuit 507, and an RGB register 508 (RGB×7-bit). A volatile memory 108 includes two SRAMs 509 and 510 (256×16-bit) and has a capacity obtained by multiplying the number of pixels by 32-bit (approximately 4 Mbits) with the two SRAMs put together. Also, in this example, a flash memory is used as a nonvolatile memory 109 and a storage circuit portion 106 is provided with two registers 511 and 512 in addition to the volatile memory 108 and the nonvolatile memory 109.

In the nonvolatile memory 109, there are stored accumulation data on a light emission period or the number of gray scales and data on a degree of deterioration in the respective pixels. At the start of using the light emitting device, an accumulation of the light emission period or the number of gray scales is 0 that is stored in the nonvolatile memory 109. With a power turning ON, the data stored in the nonvolatile memory 109 is transferred to the volatile memory 108.

When lightening is started, in the integration circuit 505, a correction coefficient stored in the register 506 is added to the video signal of 6 bits to thereby perform the correction of the video signal. An initial correction coefficient is 1. Also, in the integration circuit 505, the video signal is changed from 6 bits to 7 bits in order to increase a correction precision. The video signal added with the correction coefficient is transmitted as a video signal after correction to circuits at subsequent stages such as a signal line driver circuit 101 or a sub-frame period generating circuit (not shown) that processes the video signal so as to correspond to a sub-frame period.

On the other hand, the 7-bit video signal after correction that is added with the correction coefficient is subjected to sampling in the sampling circuit 501 of the counter 102 and is transmitted to, the register 502. Note that, when all the video signals are transmitted to the register 502, it is unnecessary to use the sampling circuit 501, However, the capacity of the volatile memory 108 can be reduced through sampling. For example, assuming that sampling is performed on the video signal once a second, it is possible to reduce an area occupied by the volatile memory 108 in a substrate to 1/60.

Here, sampling is performed once a second, but the present invention is not limited to this.

The sampled video signal is transmitted from the register 502 to the adder 503. Also, in the adder 503, the accumulation data on the light emission period or the number of gray scales, which is stored in the volatile memory 108, is inputted through the registers 511 and 512. The registers 511 and 512 are used for determining a timing at which the data is inputted from the volatile memory 108 in the adder 503. If access to the volatile memory 108 is performed at a sufficiently high speed, it is also possible to eliminate the registers 511 and 512.

In the adder 503, the light emission period or the number of gray scales such that the sampled video signal includes as information is added to the accumulation data on the light emission period or the number of gray scales stored in the volatile memory 108 and the obtained data is stored in the 176-stage line memory 504. Note that, in this example, the data processed in the line memory 504 and the volatile memory 108 is of pixels of 32 bits, respectively. With this memory capacity, the storage corresponding to about 18000 hours is attained.

The accumulation data on the light emission period or the number of gray scales that has been stored in the line memory 504 is stored in the volatile memory 108 again, is read again one second after the storage, and is added with that included in the sampled video signal. In this way, the addition is successively conducted.

At the time the power turns OFF, the data of the volatile memory 108 is stored in the nonvolatile memory 109, and setting is performed such that there arises no problem even if the data of the volatile memory 108 is deleted.

Figure 20:
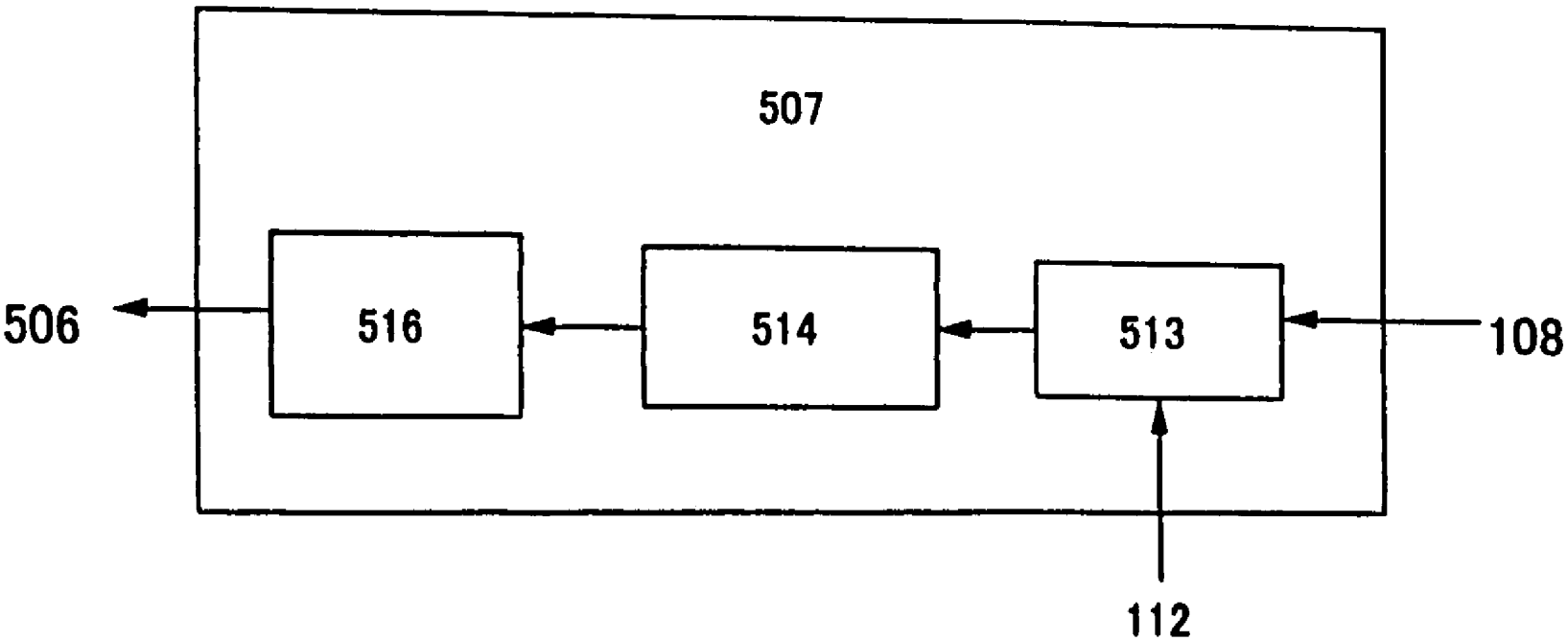
FIG. 20 is a block diagram showing an operating circuit.

FIG. 20 is a block diagram showing the arithmetic circuit 507. The accumulation data on the light emission period or the number of gray scales stored in the volatile memory 108 is inputted in an operation device 513. In the operation device 513, by using the accumulation data on the light emission period or the number of gray scales stored in the volatile memory 108 and data concerning a luminance characteristic change with time in a correction data storing portion 112, the correction coefficient is calculated. The obtained correction coefficient is temporarily stored in an 8-bit line memory 514, and is then stored in an SRAM 516. The SRAM 516 is set so as to store the correction coefficient at 256 stages for each pixel in 8 bits. This correction coefficient is temporarily stored in the register 506 and is then inputted to the integration circuit 505, and is added to the video signal to perform the correction.

Here, similarly to the case described in Embodiment mode, a voltage correction circuit 111 compares in advance the data concerning the luminance characteristic change with time stored in the correction data storing portion 112 with the accumulation data on the light emission period or the number of gray scales of the respective pixels, which is stored in the volatile memory 108, and judges the degree to which the respective pixels are deteriorated. Then, the voltage correction circuit 111 detects the specific pixel that undergoes the most significant deterioration and corrects the value of voltage supplied from a voltage source 104 to a pixel portion 103 in accordance with the degree of deterioration in the specific pixel. Specifically, in order to realize a display with a desired gray scale in the specific pixel, the value of voltage is increased.

The value of the voltage supplied to the pixel portion 103 is corrected in accordance with the specific pixel, so that in the other pixels that are less deteriorated compared with the specific pixel, an excessive amount of current is supplied to light-emitting elements and thus the desired gray scales cannot be obtained. To cope with this, the video signal correcting circuit 110 is used for correcting the video signal that determines the gray scales of the other pixels. In the video signal correcting circuit 110, there are inputted the accumulation data on the light emission period or the number of gray scales and the video signal as well. The video signal correcting circuit 110 compares in advance the data concerning the luminance characteristic change with time that is stored in the correction data storing portion 112 with the accumulation data on the light emission period or the number of gray scales of the respective pixels and judges the degree to which the respective pixels deteriorate. Then, the video signal correcting circuit 110 detects the specific pixel that undergoes the most significant deterioration and performs correction on the inputted video signal in accordance with the degree of deterioration in the specific pixel. Specifically, the correction of the video signal is performed so as to realize a desired number of gray scales. The corrected video signal is inputted to the signal line driver circuit 101.

This example can be implemented in combination with Examples 3 to 12.

What is claimed is:

1. A light emitting device comprising:

a plurality of light emitting elements;

a voltage source for supplying voltages to the plurality of light emitting elements;

means for calculating an accumulation of light emission periods of each of the plurality of light emitting elements based on video signals for controlling the light emission periods of the plurality of light emitting elements;

means for storing the calculated accumulation of the light emission periods of each of the plurality of light emitting elements;

means for storing data on a time-varying luminance characteristic of the plurality of light emitting elements;

means for determining an amount of luminance variation compared to an initial luminance of each of the plurality of light emitting elements based on the data on the time-varying luminance characteristic of the plurality of light emitting elements and the calculated accumulation of the light emission periods of the plurality of light emitting elements;

means for correcting the voltages supplied from the voltage source to the plurality of light emitting elements to return a luminance of one of the plurality of light emitting elements to the initial luminance; and means for correcting the video signals in a manner to compensate for a difference between the amount of luminance variation compared to the initial luminance of the one of the plurality of light emitting elements and an amount of luminance variation compared to the initial luminance of each of the other light emitting elements than the one of the plurality of light emitting elements, thereby correcting a gradation level of each of the other light emitting elements than the one of the plurality of light emitting elements.

2. A light emitting device according to claim 1, wherein each of the video signals has n+m bits (each of n and m denotes an integer), and wherein the m bits are extra bits used only for correcting the video signals.

3. A light emitting device according to claim 1, further comprising a sampling circuit for sampling the video signals for controlling light emission periods and gradation levels of the plurality of light emitting elements.

4. A light emitting device comprising:

a plurality of light emitting elements;

a voltage source for supplying voltages to the plurality of light emitting elements;

means for calculating an accumulation of gradation levels of each of the plurality of light emitting elements based on video signals for controlling light emission periods of the plurality of light emitting elements;

means for storing the calculated accumulation of the gradation levels of each of the plurality of light emitting elements;

means for storing data on a time-varying luminance characteristic of the plurality of light emitting elements;

means for determining an amount of luminance variation compared to an initial luminance of each of the plurality of light emitting elements based on the data on the time-varying luminance characteristic of the plurality of light emitting elements and the calculated accumulation of the gradation levels of the plurality of light emitting elements;

means for correcting the voltages supplied from the voltage source to the plurality of light emitting elements to return a luminance of one of the plurality of light emitting elements to the initial luminance; and means for correcting the video signals in a manner to compensate for a difference between the amount of luminance variation compared to the initial luminance of the one of the plurality of light emitting elements and an amount of luminance variation compared to the initial luminance of each of the other light emitting elements than the one of the plurality of light emitting elements, thereby correcting the gradation levels of each of the other light emitting elements than the one of the plurality of light emitting elements.

5. A light emitting device according to claim 4, wherein each of the video signals has n+m bits (each of n and m denotes an integer), and wherein the m bits are extra bits used only for correcting the video signals.

6. A light emitting device according to claim 4, further comprising a sampling circuit for sampling the video signals for controlling the light emission periods and the gradation levels of the plurality of light emitting elements.

7. A display device comprising:

a plurality of light emitting elements;

a voltage source for supplying voltages to the plurality of light emitting elements;

a counter portion for calculating an accumulation of light emission periods of each of the plurality of light emitting elements based on video signals for controlling the light emission periods of the plurality of light emitting elements;

a first memory circuit for storing the calculated accumulation of the light emission periods of each of the plurality of light emitting elements;

a second memory circuit for storing data on a time-varying luminance characteristic of the plurality of light emitting elements;

an arithmetic circuit for determining an amount of luminance variation compared to an initial luminance of each of the plurality of light emitting elements based on the data on the time-varying luminance characteristic of the plurality of light emitting elements and the calculated accumulation of the light emission periods of the plurality of light emitting elements;

a voltage correction circuit for correcting the voltages supplied from the voltage source to the plurality of light emitting elements to return a luminance of one of the plurality of light emitting elements to the initial luminance; and a video signal correction circuit for correcting the video signals in a manner to compensate for a difference between the amount of luminance variation compared to the initial luminance of the one of the plurality of light emitting elements and an amount of luminance variation compared to the initial luminance of each of the other light emitting elements than the one of the plurality of light emitting elements, thereby correcting a gradation level of each of the other light emitting elements than the one of the plurality of light emitting elements.

8. A display device according to claim 7, wherein each of the video signals has n+m bits (each of n and m denotes an integer), and wherein the m bits are extra bits used only for correcting the video signals.

9. A display device according to claim 7, further comprising a sampling circuit for sampling the video signals for controlling the light emission periods and the gradation levels of the plurality of light emitting elements.

10. A display device comprising:

a plurality of light emitting elements;

a voltage source for supplying voltages to the plurality of light emitting elements;

a counter portion for calculating an accumulation of gradation levels of each of the plurality of light emitting elements based on video signals for controlling light emission periods of the plurality of light emitting elements;

a first memory circuit for storing the calculated accumulation of the gradation levels of each of the plurality of light emitting elements;

a second memory circuit for storing data on a time-varying luminance characteristic of the plurality of light emitting elements;

an arithmetic circuit for determining an amount of luminance variation compared to an initial luminance of each of the plurality of light emitting elements based on the data on the time-varying luminance characteristic of the plurality of light emitting elements and the calculated accumulation of the gradation levels of the plurality of light emitting elements;

a voltage correction circuit for correcting the voltages supplied from the voltage source to the plurality of light emitting elements to return a luminance of one of the plurality of light emitting elements to the initial luminance; and a video signal correction circuit for correcting the video signals in a manner to compensate for a difference between the amount of luminance variation compared to the initial luminance of the one of the plurality of light emitting elements and the amount of luminance variation compared to the initial luminance of each of the other light emitting elements than the one of the plurality of light emitting elements, thereby correcting the gradation levels of each of the other light emitting elements than the one of the plurality of light emitting elements.

11. A display device according to claim 10, wherein each of the video signals has n+m bits (each of n and m denotes an integer), and wherein the m bits are extra bits used only for correcting the video signals.

12. A display device according to claim 10, further comprising a sampling circuit for sampling the video signals for controlling the light emission periods and gradation levels of the plurality of light emitting elements.

* * * * *